US008688023B2

(12) United States Patent
Sekihara et al.

(10) Patent No.: US 8,688,023 B2
(45) Date of Patent: Apr. 1, 2014

(54) PRESSING ROLLER AND IMAGE HEATING DEVICE USING THE PRESSING ROLLER

(75) Inventors: Yuko Sekihara, Tokyo (JP); Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 13/182,886

(22) Filed: Jul. 14, 2011

(65) Prior Publication Data

US 2012/0014726 A1 Jan. 19, 2012

(30) Foreign Application Priority Data

Jul. 15, 2010 (JP) ..... 2010-160570
Jun. 27, 2011 (JP) ..... 2011-141762

(51) Int. Cl.
*G03G 15/20* (2006.01)

(52) U.S. Cl.
USPC ..... 399/333

(58) Field of Classification Search
USPC ..... 399/331, 333
See application file for complete search history.

(56) References Cited

U.S. PATENT DOCUMENTS

| | | | | |
|---|---|---|---|---|
| 6,007,657 | A * | 12/1999 | Eddy et al. | 156/184 |
| 6,459,878 | B1 * | 10/2002 | Tomoyuki et al. | 399/331 |
| 6,952,553 | B2 * | 10/2005 | Sakakibara et al. | 399/328 |
| 6,989,182 | B2 * | 1/2006 | Chen et al. | 428/36.8 |
| 7,001,653 | B2 * | 2/2006 | Chen et al. | 428/36.91 |
| 7,008,678 | B2 * | 3/2006 | Chen et al. | 428/36.8 |
| 7,014,899 | B2 * | 3/2006 | Chen et al. | 428/36.8 |
| 7,321,746 | B2 | 1/2008 | Sakakibara et al. | |
| 7,974,563 | B2 | 7/2011 | Sakai et al. | |
| 8,005,413 | B2 | 8/2011 | Sakakibara et al. | |
| 8,224,223 | B2 * | 7/2012 | Sakakibara et al. | 399/331 |
| 8,369,763 | B2 * | 2/2013 | Sakakibara et al. | 399/331 |
| 8,369,764 | B2 * | 2/2013 | Sugawara | 399/333 |
| 8,380,113 | B2 * | 2/2013 | Natori et al. | 399/330 |
| 8,401,450 | B2 * | 3/2013 | Sekihara et al. | 399/333 |
| 2005/0214044 | A1 | 9/2005 | Sakakibara et al. | |
| 2009/0003902 | A1 | 1/2009 | Sakakibara et al. | |
| 2009/0116886 | A1 | 5/2009 | Sakai et al. | |
| 2011/0091252 | A1 | 4/2011 | Sekihara et al. | |
| 2011/0217092 | A1 | 9/2011 | Sekihara et al. | |
| 2012/0027479 | A1 * | 2/2012 | Uekawa et al. | 399/330 |

FOREIGN PATENT DOCUMENTS

| | | | | |
|---|---|---|---|---|
| JP | 11302545 | A * | 11/1999 | C08L 83/04 |
| JP | 2002351243 | A * | 12/2002 | G03G 15/20 |
| JP | 2005-273771 | | 10/2005 | |
| JP | 2008-191557 | | 8/2008 | |
| JP | 2008197585 | A * | 8/2008 | G03G 15/20 |
| JP | 2009-31772 | | 2/2009 | |
| JP | 2009-109952 | | 5/2009 | |

OTHER PUBLICATIONS

Machine Translation of Japanese Patent JP2002351243. Dec. 6, 2002.*

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

A pressing roller includes a metal core and an elastic layer containing a needle-like filler which has an average length of 0.05 mm or more and 1 mm or less and a thermal conductivity of 500 W/(mK) or more. In the elastic layer, pore portions are dispersed.

10 Claims, 10 Drawing Sheets

(a)

(b)

PRESSING ROLLER AND IMAGE HEATING DEVICE USING THE PRESSING ROLLER

FIELD OF THE INVENTION AND RELATED ART

The present invention relates to a pressing roller and an image heating device, using the pressing roller, suitable when it is used as a fixing device to be mounted in an image forming apparatus such as an electrophotographic copying machine or an electrophotographic printer.

As the fixing device to be mounted in the electrophotographic copying machine or printer, a film fixing type fixing device has been known. The fixing device of this type includes a heater which includes a ceramic substrate and a heat generating resistor formed on the substrate, a fixing film movable in contact with the heater, and a pressing roller for forming a nip between the pressing roller and the fixing film contacted to the heater. A recording material for carrying an unfixed toner image is heated while being nip-conveyed in the nip of the fixing device, so that the toner image on the recording material is heat-fixed on the recording material. This fixing device has the advantage such that a time (rising time) required from start of energization to the heater until a temperature of the heater is increased up to a fixable temperature is short. Therefore, the printer in which the fixing device is mounted can shorten a time from input of a print instruction to output of an image on a first sheet of the recording material (FPOT: first printout time). Further, the fixing device of this type has also the advantage such that power consumption during stand-by in which the printer awaits the print instruction is decreased.

In the fixing device using the fixing film, in general, the pressing roller is rotated by a driving motor and then the fixing film is rotated by being caused to follow the rotation of this pressing roller. In the printer in which this fixing device is mounted, it has been known that when a small-sized recording material is subjected to continuous printing with the same printing interval as that for a large-sized recording material, an area (non-sheet-passing area) of the heater in which the recording material is not passed is excessively increased in temperature (referred to as non-sheet-passing portion temperature rise). This non-sheet-passing portion temperature rise is more liable to occur with an increase in processing speed (process speed) of the printer. This is because a time when the recording material passes through the nip is decreased with speed-up and therefore a fixing temperature necessary to heat-fix a toner image on the recording material is increased in many cases. Thus, when the non-sheet-passing portion temperature rise occurs, there is a possibility that respective parts constituting the fixing device are damaged. Further, when a large-sized recording material is subjected to printing in a state in which the non-sheet-passing portion temperature rise occurs, the toner is excessively melted at a portion corresponding to the non-sheet-passing area on the recording material to cause high-temperature offset in some cases.

In order to prevent an occurrence of such a problem, as one of means for reducing the degree of the non-sheet-passing portion temperature rise, such a method that a thermal conductivity of the pressing roller with respect to a longitudinal direction is increased has been known. In this method, a heat transfer property of an elastic layer (rubber layer) provided in the pressing roller is aggressively improved to accelerate movement of the heat in the longitudinal direction of the pressing roller, so that the degree of the non-sheet-passing portion temperature rise is alleviated.

Japanese Laid-Open Patent Application (JP-A) 2005-273771 discloses a pressing roller in which pitch-based carbon fibers are dispersed on a metal core. In this pressing roller, the thermal conductivity of the rubber layer is high and therefore the pressing roller is effective in alleviation of the degree of the non-sheet-passing portion temperature rise. JP-A 2009-31772 discloses a pressing roller in which a rubber layer in which pitch-based carbon fibers are dispersed is provided on a solid rubber elastic layer. In this pressing roller, the pitch-based carbon fibers are oriented in the roller longitudinal direction in the rubber layer in which the carbon fibers are dispersed and therefore a property such that the thermal conductivity with respect to particularly the roller longitudinal direction is high (thermal conductivity anisotropy) is exhibited, so that the pressing roller is effective in alleviation of the degree of the non-sheet-passing portion temperature rise.

The pressing roller disclosed in JP-A 2005-273771 is excellent in thermal conductivity of the elastic layer and is effective in alleviating the degree of the non-sheet-passing portion temperature rise but the thermal conductivity with respect to a thickness direction of the rubber layer is also high and therefore the heat is liable to be dissipated into the metal core. For this reason, in a process in which the fixing device at the time of start of the printing is increased in temperature up to a predetermined temperature (hereinafter referred to as during rising), a temperature rising speed of the fixing film surface is less liable to be increased.

In the pressing roller disclosed in JP-A 2009-31772, the rubber layer in which the pitch-based carbon fibers are oriented and dispersed is provided on the solid rubber elastic layer. As a result, the thermal conductivity with respect to the roller longitudinal direction is excellent and is effective in alleviation of the degree of the non-sheet-passing portion temperature rise, and a heat insulating property is also good and therefore the heat is less liable to be dissipated in the rubber layer thickness direction. However, in order to further shorten a time from start of printing until the fixing can be started, a further improvement in heat insulating property with respect to the rubber layer thickness direction is required.

SUMMARY OF THE INVENTION

A principal object of the present invention is to provide a pressing roller capable of improving a heat conductive property of an elastic layer with respect to a longitudinal direction of a pressing member and also capable of improving a heat insulating property with respect to a thickness direction of the elastic layer.

Another object of the present invention is to provide an image heating device including the pressing roller.

According to an aspect of the present invention, there is provided a pressing roller comprising:

a metal core; and an elastic layer containing a needle-like filler or whisker which has an average length of 0.05 mm or more and 1 mm or less and a thermal conductivity of 500 W/(mK) or more, wherein in the elastic layer, pore portions are dispersed.

According to another aspect of the present invention, there is provided an image heating device comprising:

a heating member for heating a recording material on which an image is carried;

a pressing roller including a metal core and an elastic layer containing a needle-like filler which has an average length of 0.05 mm or more and 1 mm or less and a thermal conductivity of 500 W/(mK) or more, wherein the elastic layer forms, together with the heating member, a nip in which the recording material is to be nip-conveyed, wherein in the elastic layer, pore portions are dispersed.

These and other objects, features and advantages of the present invention will become more apparent upon a consideration of the following description of the preferred embodiments of the present invention taken in conjunction with the accompanying drawings.

Figure 2:
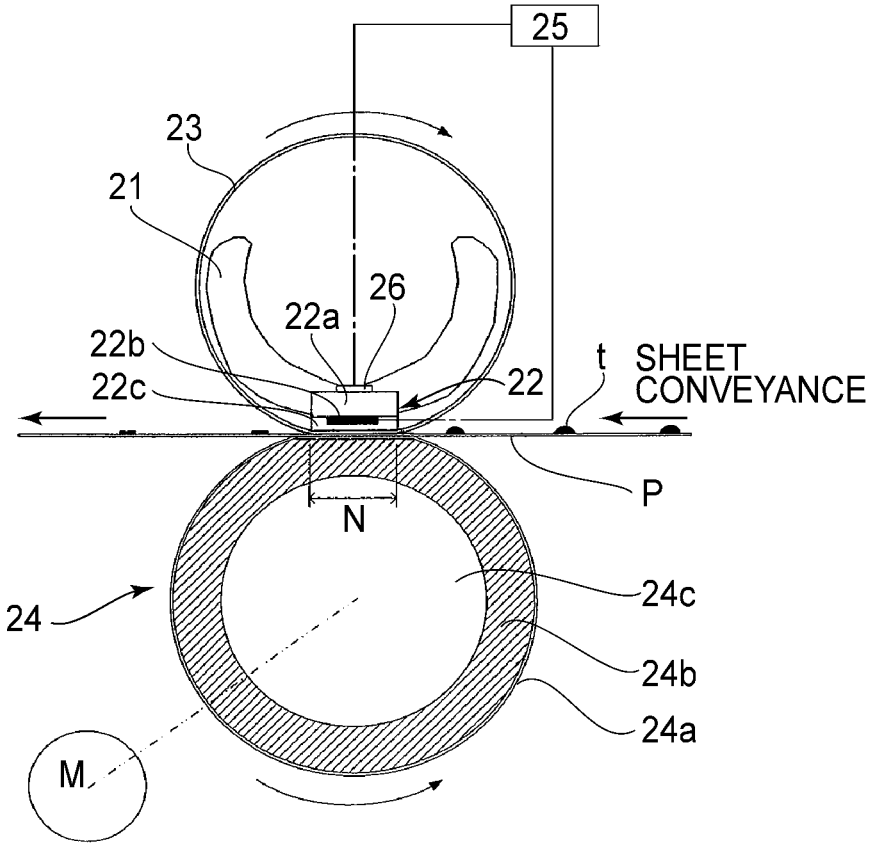
Figure 2:
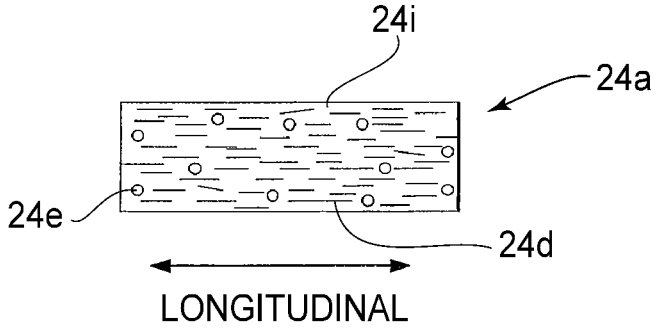

Part (a) of FIG. 2 is a schematic cross-sectional view of a fixing device, and (b) of FIG. 2 is a longitudinal sectional view of an elastic layer of a pressing roller.

Figure 3:
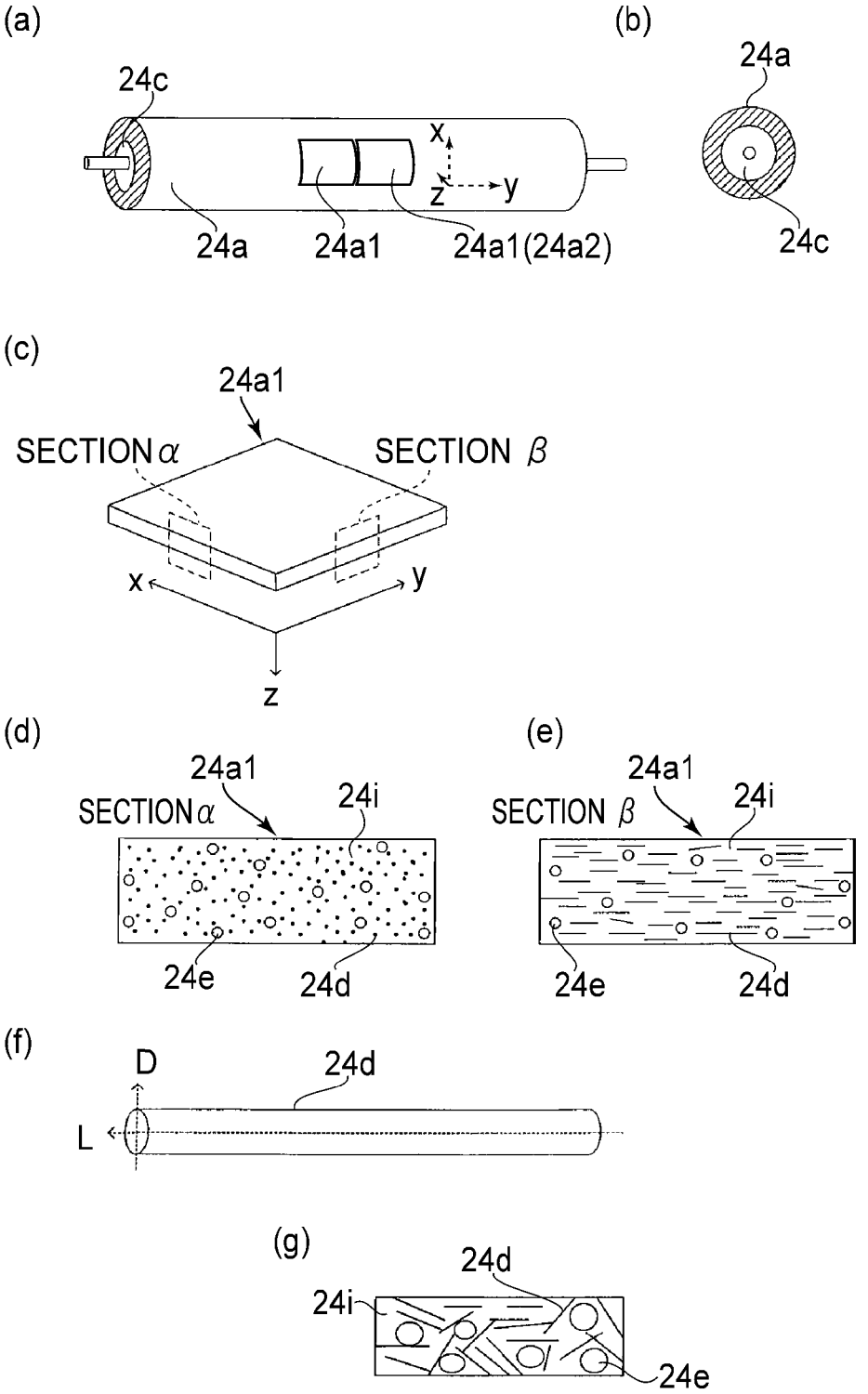

Part (a) of FIG. 3 is a perspective view of an elastic layer molded product prepared by molding an elastic layer on an outer peripheral surface of a metal core, (b) is a right side view of the elastic layer molded product, (c) is an enlarged view of a cut sample of the elastic layer of the elastic layer molded product, (d) and (e) are enlarged views of a cross-section α and a cross section β, respectively, of the cut sample of the elastic layer, (f) is an illustration of a fiber diameter portion and a fiber length portion of a needle-like filler and (g) is a schematic view showing a state in which the needle-like filler is hindered by a hollow member in the elastic layer.

Figure 4:
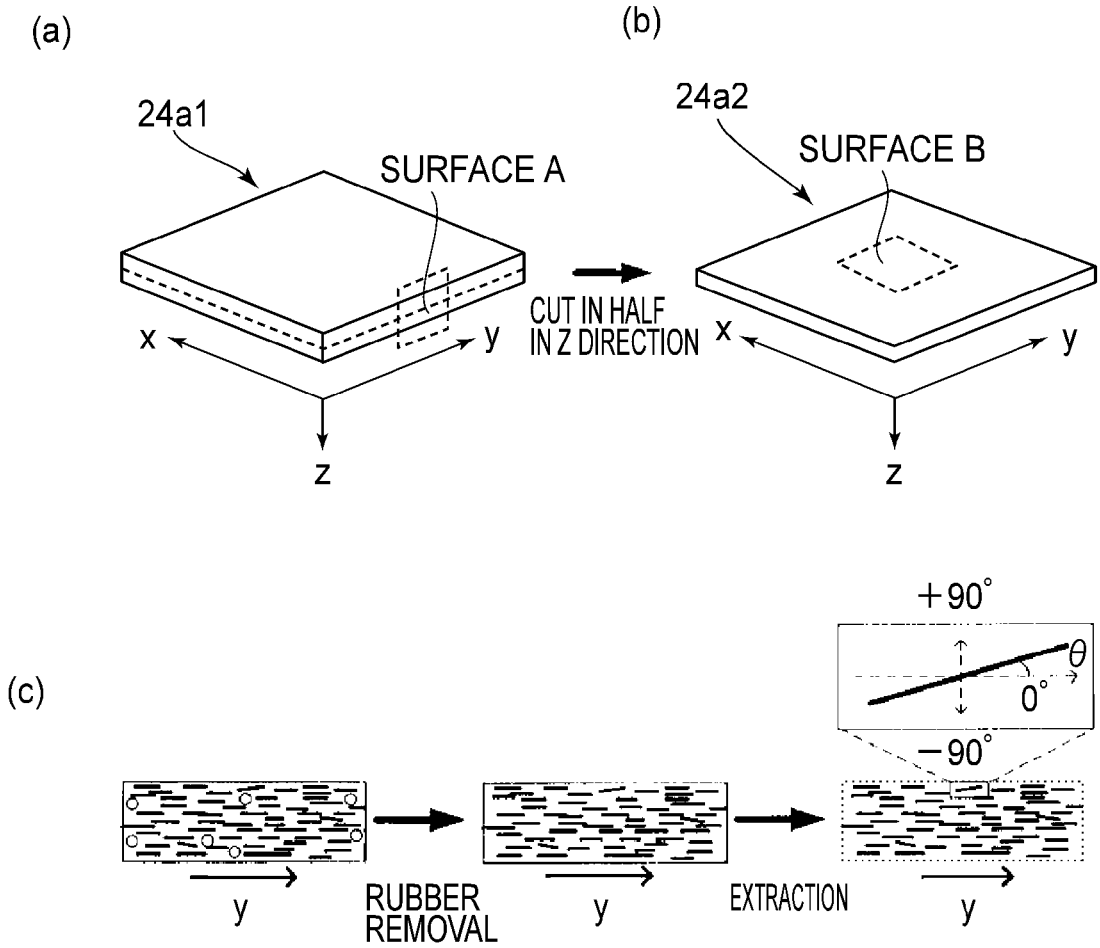

Parts (a), (b) and (c) of FIG. 4 are schematic views for illustrating the definition of an orientation degree.

Figure 5:
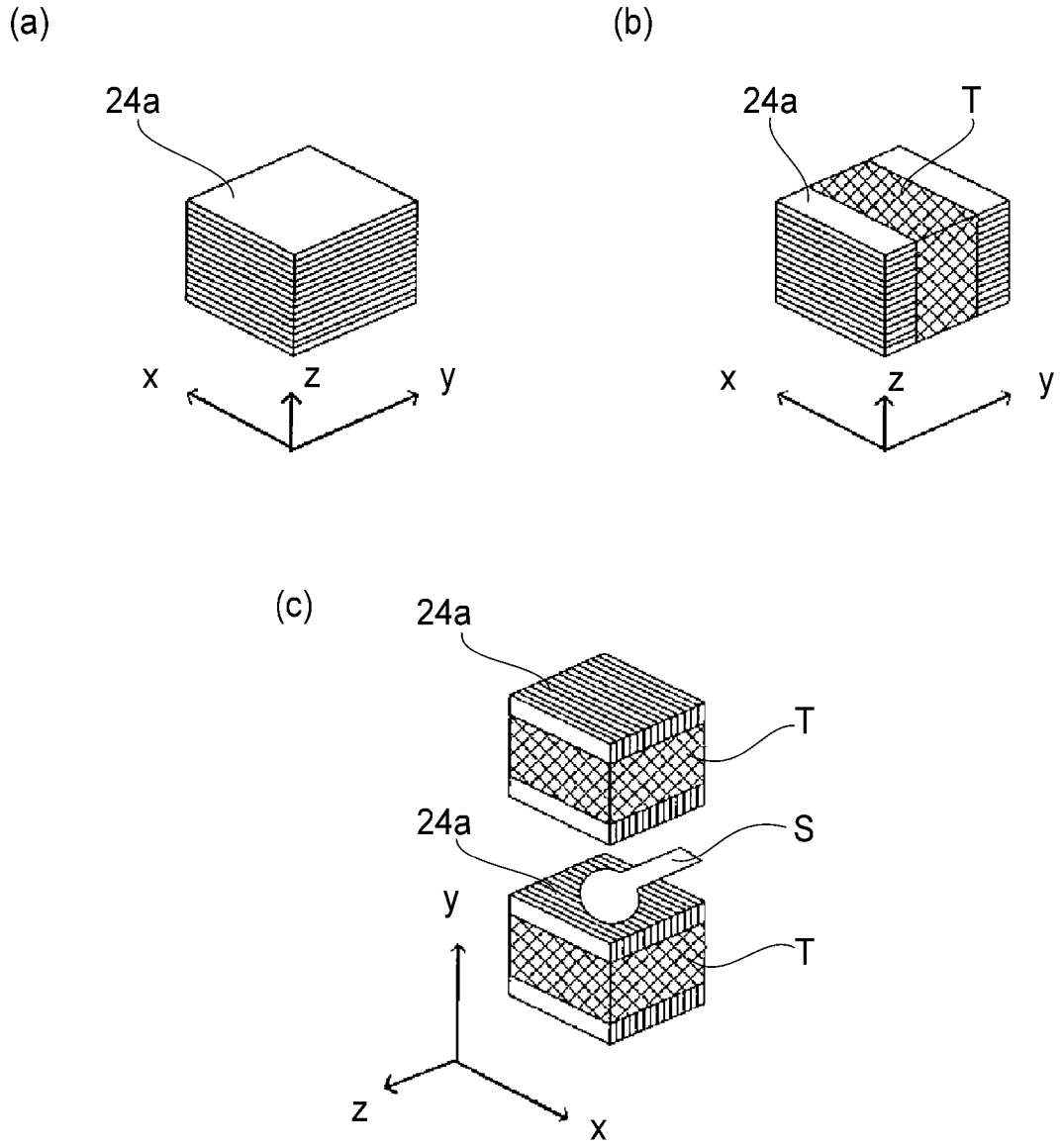

Parts (a), (b) and (c) of FIG. 5 are schematic views for illustrating measuring method of a thermal conductivity of the elastic layer.

Figure 6:
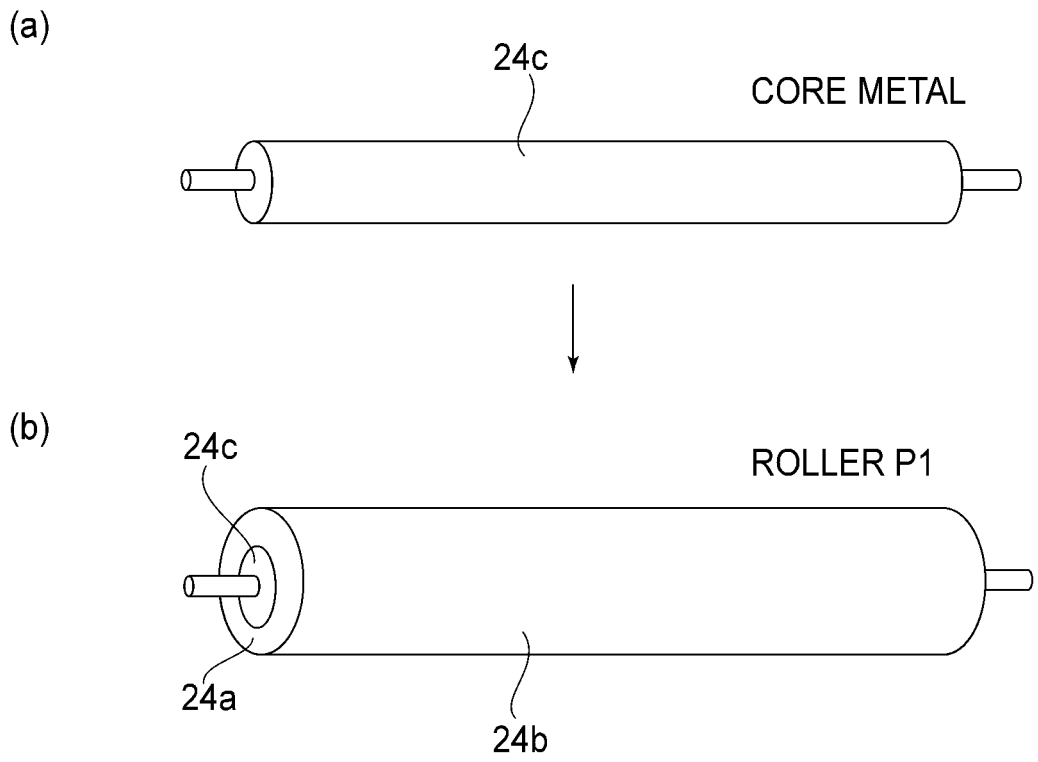

Parts (a) and (b) of FIG. 6 are schematic views for illustrating a molding procedure of each of a pressing roller in Embodiment 1 and a pressing roller in Comparative Embodiment 1.

Figure 7:
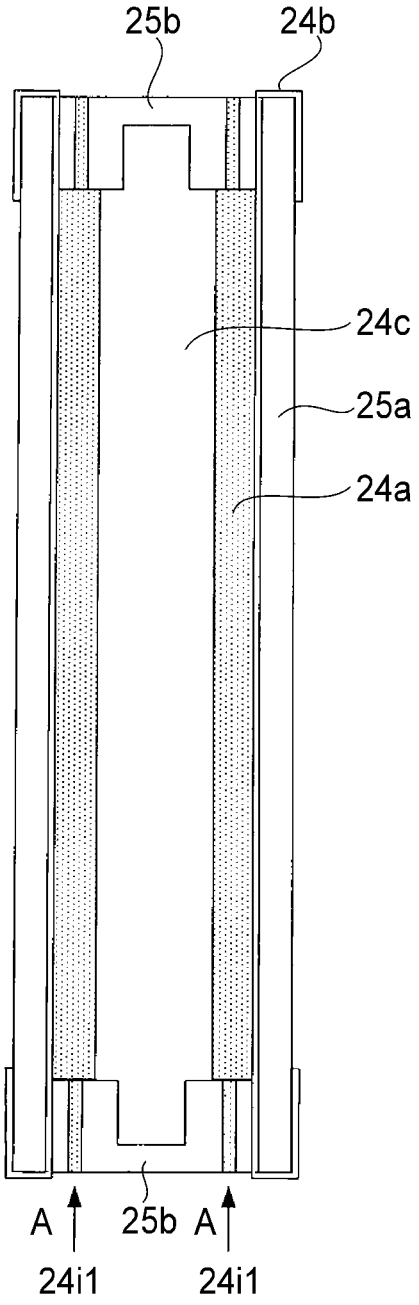

FIG. 7 is a schematic view for illustrating a manufacturing method of each of the pressing roller in Embodiment 1 and the pressing roller in Comparative Embodiment 1.

Figure 8:
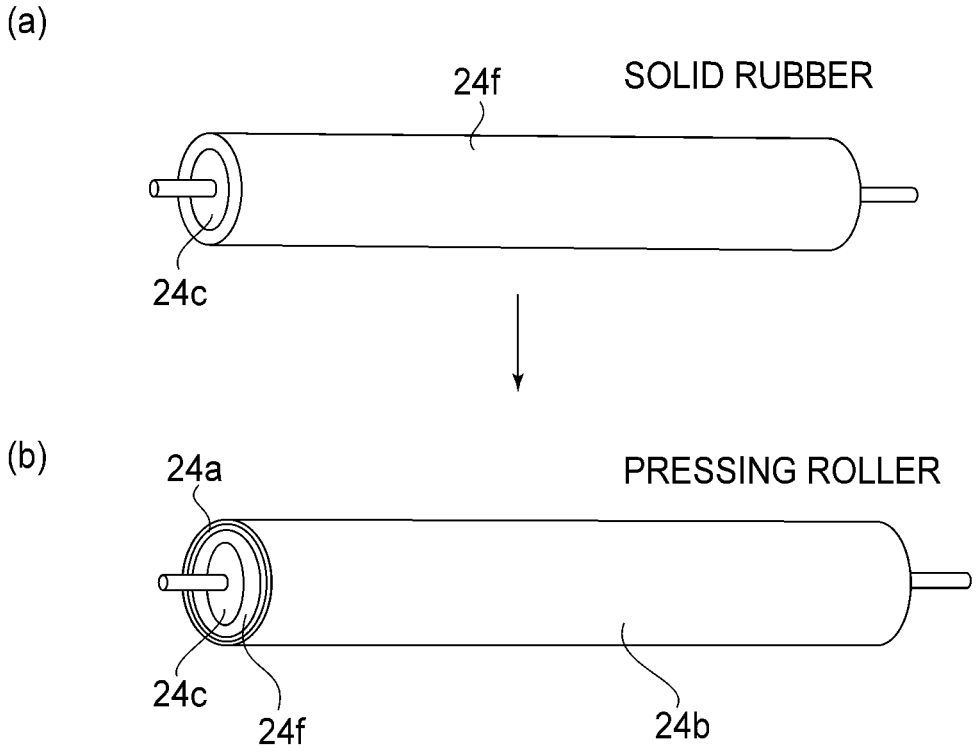

Parts (a) and (b) of FIG. 8 are schematic views for illustrating a molding procedure of each of pressing rollers in Embodiments 2 to 7 and pressing rollers in Comparative Embodiments 2 to 7.

Figure 9:
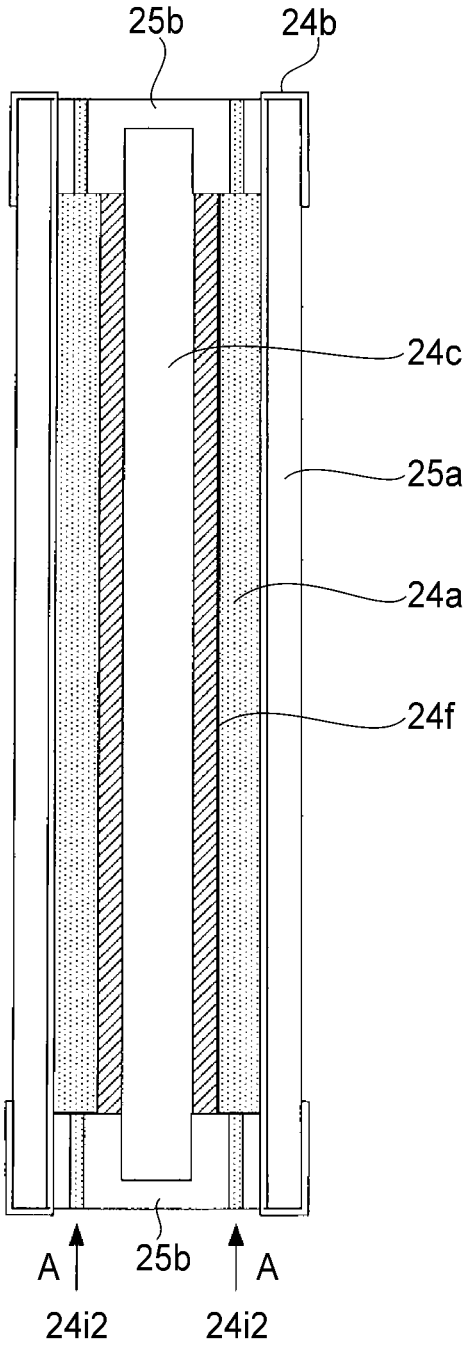

FIG. 9 is a schematic view for illustrating a manufacturing method of each of the pressing rollers in Embodiments 2 to 7 and the pressing rollers in Comparative Embodiments 2 to 7.

Figure 10:
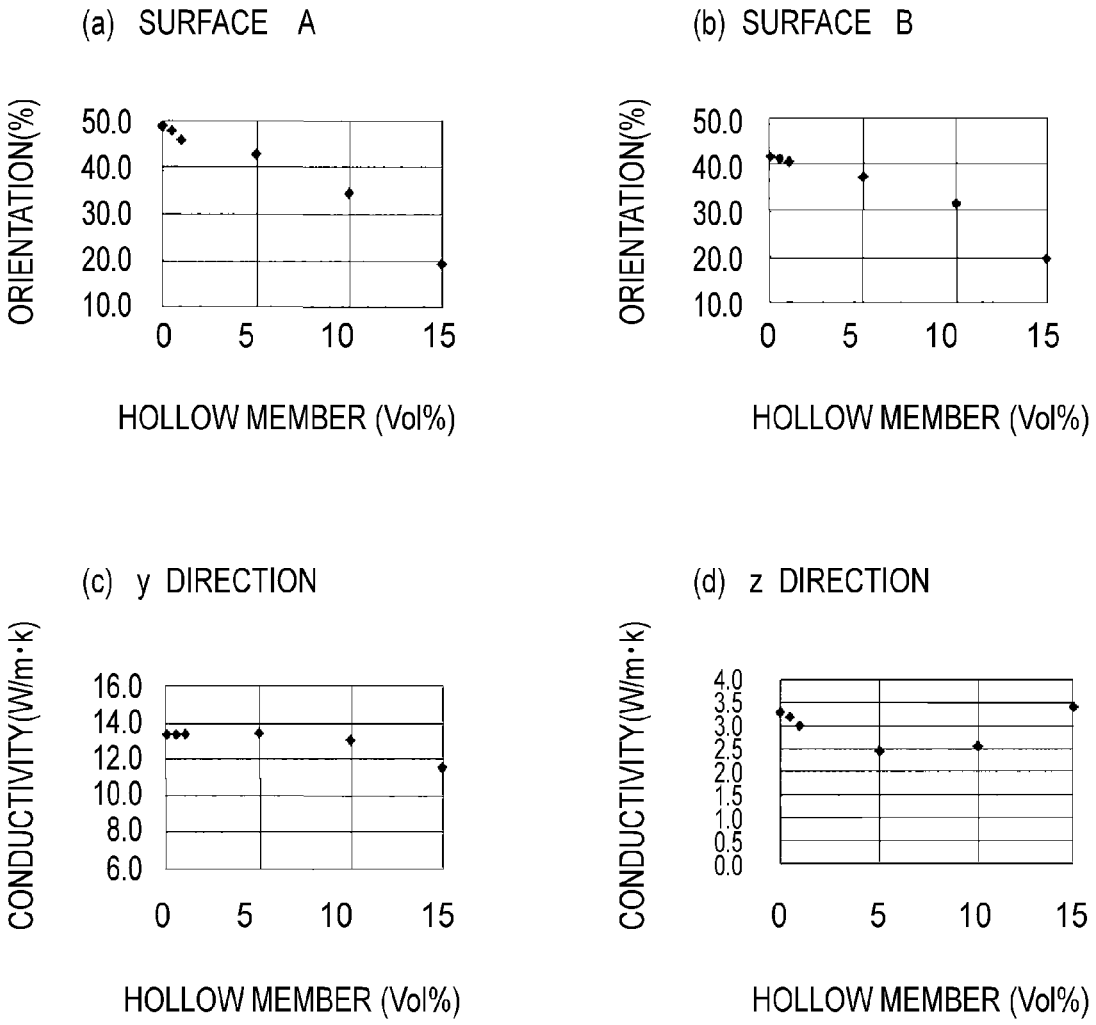

Parts (a), (b), (c) and (d) of FIG. 10 are graphs showing evaluation results of the pressing rollers in Embodiments 1 to 7 and the pressing rollers in Comparative Embodiments 1 to 7.

DESCRIPTION OF THE PREFERRED EMBODIMENTS (1) Image Forming Apparatus

Figure 1:
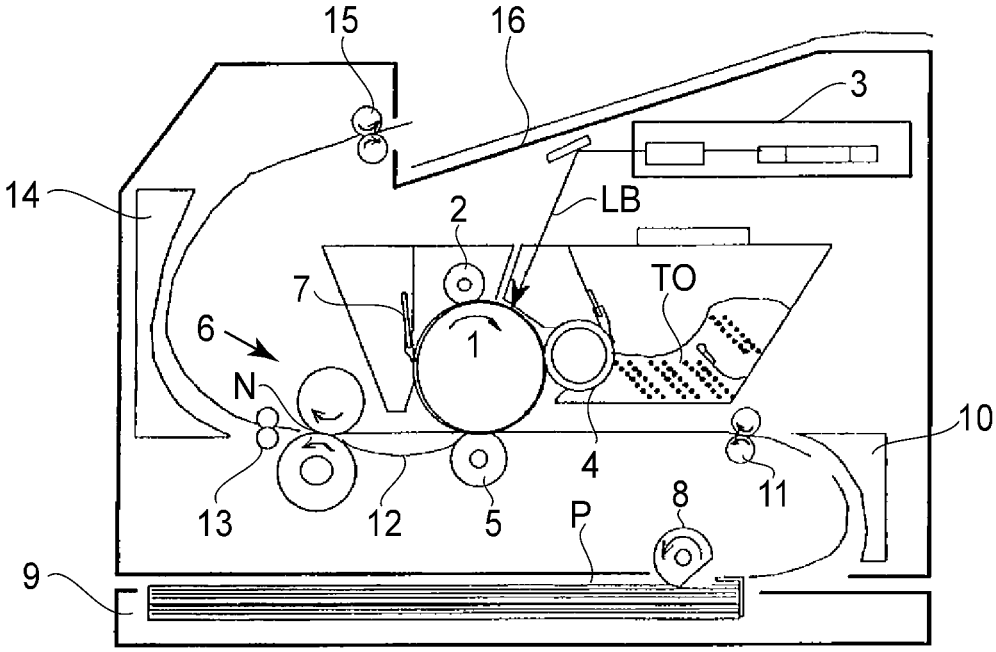
FIG. 1 is a schematic structural illustration of an example of an image forming apparatus.

FIG. 1 is a schematic structural view of an example of an image forming apparatus in which an image heating device according to the present invention is mounted as a fixing device. This image forming apparatus is a laser beam printer of an electrophotographic type.

The printer in this embodiment includes a rotation drum type electrophotographic photosensitive member (hereinafter referred to as a photosensitive drum) 1 as an image bearing member. The photosensitive drum 1 is prepared by forming a layer of a photosensitive material of OPC, amorphous Se, amorphous Si or the like on an outer peripheral surface of a cylinder (drum)-like electroconductive substrate formed of a metal material such as aluminum or nickel. The photosensitive drum 1 is rotated in an arrow direction at a predetermined peripheral speed (process speed) depending on a print instruction outputted from an external device such as a host computer or a terminal machine on the network. Then, during this rotation process, the one peripheral surface of the photosensitive drum 1 is uniformly charged to a predetermined polarity and a predetermined potential by a charging roller 2 as a charging means. The uniformly charged surface of the photosensitive drum 1 is subjected to scanning exposure to a laser beam LB, which is modulation controlled (ON/OFF-controlled) depending on image information, from the external device, outputted from a laser beam scanner 3 as a scanning exposure device. As a result, an electrostatic latent image (electrostatic image) depending on an objective image information is formed on the surface of the photosensitive drum 1. A developing device 4 as a developing means deposits toner developer TO on the latent image, thus developing the latent image as a toner image (developer image). As a developing method, a jumping developing method, a two-component developing method, FEED developing method or the like are used and in many cases, a combination of image exposure and a reverse developing system is employed.

Separately, a recording material P accommodated and stuck in a sheet feeding cassette 9 is fed one by one by rotation of a feeding roller 8 and passes through a sheet path including a guide 10, thus being conveyed to a registration roller 11. The registration roller 11 feeds the recording material P, with predetermined control timing, to a transfer nip between the photosensitive drum surface and the outer peripheral surface of a transfer roller 5. The recording material P is nip-conveyed in the transfer nip and in this conveyance process, the toner image on the photosensitive drum 1 surface is successively transferred onto the recording material P by a transfer bias applied to the transfer roller 5. As a result, the recording material P carries an unfixed toner image.

The recording material P carrying the unfixed toner image (unfixed image) thereon is sequentially separated from the photosensitive drum 1 surface and is discharged from the transfer nip. Then, the recording material P is introduced into a nip N of a fixing device 6 through a conveyance guide 12. The recording material P passes through the nip N, so that the toner image is heat-fixed on the surface of the recording material P. The recording material P coming out of the fixing device 6 passes through a sheet path including a conveying roller 13, a guide 14 and a discharging roller 15 and is discharged on a discharge tray 16 as a print-out product.

The surface of the photosensitive drum 1 after the separation of the recording material P therefrom is subjected to removal of a deposited contaminant such as transfer residual toner by a cleaning device 7 as a cleaning means, thus being cleaned. Then, the photosensitive drum 1 is repetitively subjected to image formation.

The printer in this embodiment is an A4-sized paper compatible printer and the process speed thereof is 60 sheets/min (A4 portrait). Further, as the toner, a styrene-acrylic resin material is used as a principal material and in the principal material, a charge control agent, a magnetic material, silica and the like are internally or externally added as desired. The resultant toner having a glass transition point of 55-65° C. was used.

(2) Fixing Device (Image Heating Device) 6

In the following description, with respect to the fixing device and members constituting the fixing device, a longitudinal direction refers to a direction perpendicular to a recording material conveyance direction on the surface of the recording material. A widthwise direction refers to a direction parallel to the recording material conveyance direction on the surface of the recording material. A length refers to a dimension with respect to the longitudinal direction. A width refers to a dimension with respect to the widthwise direction.

The fixing device 6 in this embodiment includes a cylindrical flexible film 23 as a heating member (hereinafter referred to as a fixing film) and a ceramic heater 22 as a heating member. Further, the fixing device 6 includes a film guide 21 and a pressing roller 24 as a pressing member. These members are elongated members extending in the longitudinal direction. The film guide 21 is formed in a substantially semicircular trough shape in cross section. The film guide 21 is a molded product of a heat resistant resin material such as PPS (polyphenylene sulfide) or a liquid crystal polymer or the like. The film guide 21 is supported at its longitudinal end portions by a device frame (not shown) of the fixing device 6.

The heater 22 has a low thermal capacity as a whole and is an elongated member extending in the longitudinal direction. This heater 22 is accommodated in a groove provided along the longitudinal direction at a substantially central portion of the lower surface of the film guide 21 with respect to the widthwise disperse. The heater 22 includes an elongated heater substrate 22*a* of alumina extending in the longitudinal direction of the fixing film 23. Further, on a fixing film 23-side surface of the heater substrate 22*a*, a heat generating resistor (energization heat generating element) 22*b* is provided in a linear shape or a fine stripe shape along the longitudinal direction of the heater substrate. To the heat generating resistor 22*b*, electric energy is supplied from an energization controller 25 described later through an electric energy supply electrode (not shown) provided inside and at each of longitudinal portions of the heater substrate 22*a*. Further, on a fixing film 23-side surface of the heater substrate 22*a*, a thin surface protective layer 22*c*, such as a glass layer, for covering and protecting the energization heat generating element 22*b* is provided.

The fixing film 23 is loosely engaged externally with the film guide 21 by which the heater 22 is supported. The fixing film 23 is a composite layer film formed, by coating a parting layer on the surface of a cylindrical base film, in a total thickness of 100 μm or less, preferably 20 μm or more and 60 μm or less in order to improve a quick start property by reducing the thermal capacity. As the material for the base film, it is possible to use a resin material such as PI (polyimide), PAI (polyamideimide), PEEK (polyether ether ketone) or PES (polyether sulfone) or a metal material such as SUS or Ni. As the material for the parting layer, it is possible to use a fluorine-containing resin material such as PTFE (polytetrafluoroethylene), PFA (tetrafluoroethylene-perfluoroalkylvinyl ether) or FEP (tetrafluoroethylene-hexafluoropropylene).

The pressing roller 24 includes a cylindrical shaft metal core 24*c* formed of the metal material such as iron or aluminum, an elastic layer 24*a* provided on the outer peripheral surface of the metal core 24*c*, and a tube 24*b* as a parting layer provided to cover the outer peripheral surface of the elastic layer 24*a*. The pressing roller 24 is disposed under and in contact with the fixing film 23 and is supported rotatably by the device frame via bearings (not shown) at longitudinal end portions of the metal core 24*c*. Further, the pressing roller 24 is urged by urging springs (not shown) with a predetermined urging force, so that the elastic layer 24*a* of the pressing roller 24 is elastically deformed to form the fixing nip N with a predetermined width between the fixing film 23 surface and the pressing roller 24 surface.

In the fixing device 6 in this embodiment, a fixing motor M as a driving source is rotationally driven depending on the print instruction. A rotational force of an output shaft of the fixing motor M is transmitted to the metal core 24*c* of the pressing roller 24 via a predetermined gear train (not shown), so that the pressing roller 24 is rotated in an arrow direction. The rotational force of the pressing roller 24 is transmitted to the fixing film 23 in the fixing nip N by a frictional force between the pressing roller 4 surface and the fixing film 23 surface. As a result, the fixing film 23 is rotated in an arrow direction by the rotation of the pressing roller 24 while being contacted to the surface protecting layer 22*c* of the heater 22 at inner peripheral surface of the fixing film 24. Further, depending on the print instruction, the energization controller 25 supplies the electric energy to the heat generating resistor 22*b* via the electric energy supply electrode of the heater 22. As a result, so that the heat generating resistor 22*b* generates heat and thus the heater 22 is quickly increased in temperature to heat the fixing film 23. The temperature of the heater 22 is detected by a temperature detecting element (temperature detecting member) 26 such as a thermistor provided on a substrate surface of the heater substrate 22*a* at a side opposite from the heat generating resistor 22*b* side. The energization controller 25 obtains (reads) a temperature detection signal (output signal) outputted from the temperature detecting element 26 and on the basis of this temperature detection signal, and controls the energization to the heat generating resistor 22*b* so as to maintain the temperature of the heater 22 at a predetermined fixing temperature (target temperature). In a state in which the fixing motor M is rotationally driven and the energization to the heat generating resistor 22*b* of the heater 22 is controlled, the recording material P on which an unfixed toner image t is carried is introduced into the fixing nip N with a toner image carrying surface upward. The recording material P is nipped in the fixing nip N between the fixing film 23 surface and the pressing roller 24 surface and is then conveyed (nip-conveyed) in the nipped state. In this conveying process, the toner image t is heated and melted by the heater 22 via the fixing film 23 and is supplied with the nip pressure, so that the toner image t is heat-fixed on the surface of the recording material P.

(3) Pressing Roller 24

Materials constituting the pressing roller 24, a manufacturing method (process), and the like will be described below in detail.

3-1) Layer Structure of Pressing Roller 24

As described above, the pressing roller 24 includes the cylindrical shaft metal core 24*c*, the elastic layer 24*a* and the tube 24*b* as the parting layer.

3-1-1) Elastic Layer 24*a*

Part (b) of FIG. 2 is a sectional view of the elastic layer 24*a* with respect to the longitudinal direction of the pressing roller 24. The pressing roller 24 in this embodiment is characterized by the structure of the elastic layer 24*a* thereof. That is, as shown in (b) of FIG. 2, in a predetermined heat resistant elastic material 24*i* as a matrix material of the elastic layer 24*a*, a needle-like filler 24*d* having thermal conductivity is present in a state in which it is oriented in the pressing roller longitudinal direction (hereinafter referred to as a roller longitudinal direction). In the needle-like filler 24*d* oriented in the roller longitudinal direction, a hollow member 24*e* for providing a heat resistant performance is formed in a dispersed state.

As a heat resistant elastic material as the matrix material of the elastic layer 24*a*, it is possible to use a general purpose heat resistant solid rubber elastic material such as a silicone rubber or a fluorine-containing rubber. Both of the silicone rubber and the fluorine-containing rubber have sufficient heat resistant property and durability and preferable elasticity (softness) in the case where they are used in the fixing device 6. In the case where the silicone rubber is used, from the viewpoints of availability and ease of processing, a liquid addition-curable silicone rubber is preferred. In this embodiment, as the heat resistant elastic material, the liquid addition-curable silicone rubber is used but the heat resistant elastic material is not limited thereto. Other elastic materials may also be used.

The needle-like filler 24*d* include fibers each having an elongated fiber shape as shown in (f) of FIG. 3 and has the thermal conductivity anisotropy in the fibers. Here, the thermal conductivity anisotropy refers to a property such that the thermal conductivity of the needle-like filler 24*d* is high only with respect to a long axis disperse (length layer) and is low with respect to a radial disperse. Thus, the needle-like filler 24*d* is dispersed in the liquid addition-curable silicone rubber 24*i* and is oriented in the roller longitudinal direction, so that the high thermal conductivity can be provided with respect to the roller longitudinal direction.

The hollow member 24*e* is formed in a dispersed state among the fibers of the needle-like filler 24*d* oriented in the elastic layer 24*a*.

(a) State of Needle-Like Filler 24*d* and Hollow Member 24*e* In Elastic Layer 24

In FIG. 3, (a) is a perspective view showing the entire elastic layer molded product prepared by molding the elastic layer 24*a* on the outer peripheral surface of the metal core 24*c*, (b) is a right side view of the elastic layer molded product shown in (a), (c) is an enlarged perspective view of a cut sample 24*a*1 of the elastic layer 24*a* of the elastic layer molded product shown in (a), (d) and (e) are enlarged views of cross sections α and β, respectively, of the cut sample 24*a*1 of the elastic layer 24*a* shown in (c), and (f) is a schematic view for illustrating a fiber diameter portion D and a fiber length portion L of the needle-like filler 24*d*.

As shown in (a) of FIG. 3, the elastic layer 24*a* of the elastic layer molded product is cut in X direction (circumferential disperse) and y disperse (longitudinal direction) to obtain the cut sample 24*a*1 of the elastic layer 24*a*. Then, as shown in (c) of FIG. 3, the cut sample 24*a*1 is subjected to observation of the cross section a with respect to the x direction and of the cross section with respect to the y direction. At the cross section a with respect to the x direction, as shown in (d) of FIG. 3, the fiber diameter portion D ((f) of FIG. 3) of the needle-like filler 24*d* is principally observed. On the other hand, at the cross section with respect to the y direction, as shown in (e) of FIG. 3, the fiber length portion L ((f) of FIG. 3) of the needle-like filler 24*d* is observed dominantly. This is because the needle-like filler 24*d* has the elongated fiber shape and therefore when is kneaded with the liquid addition-curable silicone rubber before curing and then is molded, the fiber length portion L of the needle-like filler 24*d* is liable to be oriented in a flowing disperse of the liquid addition-curable silicone rubber, i.e., the roller longitudinal direction of the elastic layer. Further, as at the cross section β, the hollow member 24*e* is desirably in a state in which the orientation of the needle-like filler 24*d* is not hindered. For that reason, by forming the hollow member 24*e* with a predetermined average particle size and proportion, it is possible to create a state in which the hollow member 24*e* is dispersed among the fibers of the needle-like filler 24*d* oriented in the roller longitudinal direction.

(b) Needle-Like Filler (Elongated Fiber-Like Filler) 24*d*

As the needle-like filler 24*d*, from a heat conduction performance of the needle-like filler 24*d*, pitch-based carbon fiber manufactured by using petroleum pitch or coal pitch as a starting material is preferable. Further, in order to enhance the effect of alleviating (reducing) the degree of the non-sheet-passing portion temperature rise, a thermal conductivity γ of the needle-like filler 24*d* with respect to the long axis disperse may preferably be 500 W/(mK) or more. The thermal conductivity γ was measured by using a laser flash method thermal constant measuring system ("TC-7000", mfd. by ULVAC-RIKO, Inc.).

Further, when an average length of the needle-like filler 24*d* is shorter than 50 μm (0.05 mm), the thermal conductivity anisotropic effect is less liable to be obtained in the elastic layer 24*a*, so that the non-sheet-passing portion temperature rise alleviating effect becomes small. When the average length of the needle-like filler 24*d* is longer than 1 mm, at the time of being kneaded with the liquid addition-curable silicone rubber 24*i*, the viscosity of the liquid addition-curable silicone rubber 24*i* becomes excessively high, so that it becomes difficult to mold the liquid addition-curable silicone rubber 24*i*. Therefore, in order to easily obtain the thermal conductivity anisotropic effect in the elastic layer 24*a* and to obtain the non-sheet-passing portion temperature rise alleviating effect, the needle-like filler 24*d* of 0.05 mm or more and 1 mm or less in average length and 500 W/(mK) or more in thermal conductivity with respect to the long axis disperse may preferably be used. Further, an average fiber diameter of the needle-like filler 24*d* may preferably be about 10 μm. In this embodiment, the average length of the needle-like filler 24*d* is obtained by observation through an optical microscope.

A lower limit of the content of the needle-like filler 24*d* in the elastic layer 24*a* may preferably be 5 vol. % or more. Below 5 vol. %, the thermal conductivity with respect to the roller longitudinal direction is lowered and an expected effect of alleviating the degree of the non-sheet-passing portion temperature rise. An upper limit of the content of the needle-like filler 24*d* in the elastic layer 24*a* may preferably be 40 vol. % or less. Above 40 vol. %, it becomes difficult to process and mold the elastic layer 24*a*. Therefore, the content of the needle-like filler 24*d* in the elastic layer 24*a* may preferably be 5 vol. % or more and 40 vol. % or less. A volume ratio of the needle-like filler 24*d* to the elastic layer 24*a* is obtained from; (Volume of whole needle-like filler 24*d* contained in elastic layer 24*a*)/(Volume of whole elastic layer 24*a*)×100 (vol. %).

(c) Hollow Member 24*e*

Part (g) of FIG. 3 is a schematic view for illustrating the state in which the needle-like filler 24*d* is hindered by the hollow member 24*e*. The hollow member 24*e* is used to provide pore portions. As the material for the hollow member 24*e*, there are a microballoon material, a resin balloon, a glass balloon, a silica balloon, a carbon balloon and Shirasu Balloon. The hollow member 24*i* may also be formed by using a water-absorbing polymer for producing pores by vaporizing water (moisture), incorporated in advance, during heat-curing of the liquid addition-curable silicone rubber 24*i*.

The average particle size of the hollow member 24*e* in the elastic layer 24*a* after the curing may preferably be 70 μm or less. When the average particle size of the hollow member 24*e* is larger than 70 μm, as shown in (g) of FIG. 3, the needle-like filler 24*d* is hindered by the hollow member 24*e* and is not readily oriented in the roller longitudinal direction, so that the thermal conductivity with respect to the roller longitudinal direction is lowered and thus the heat insulating performance of the elastic layer 24*a* with respect to the thickness disperse is impaired. Therefore, in order to properly orient the needle-like filler 24*d* in the roller longitudinal direction, the average particle size of the hollow member 24*e* may preferably be 70 μm or less.

Further, a lower limit of the amount of the hollow member 24*e* formed in the elastic layer 24*a* may preferably be 1 vol. %. Below 1 vol. %, a desired heat resistant effect of the elastic layer 24*a* with respect to the thickness direction cannot be obtained. An upper limit of the hollow member 24*e* formed in the elastic layer 24*a* may preferably be 10 vol. %. Above 10 vol. %, the hollow member 24*e* hinders the orientation of the needle-like filler 24*d* in the roller longitudinal direction. Therefore, in order to obtain a predetermined heat insulating effect with respect to the thickness direction of the elastic layer 24*a* and in order that the orientation of the needle-like filler 24*d* in the roller longitudinal direction is not hindered, the amount of the hollow member 24*e* formed in the elastic layer 24*a* may preferably be 1 vol. % or more and 10 vol. % or less. A volume ration of the hollow member 24*e* to the elastic layer 24*a* is obtained by: (Volume of whole hollow member 24*e* formed in elastic layer 24*a*)/(Volume of whole elastic layer 24*a*)×100 (vol. %).

The hollow member 24*e* in the elastic layer 24*a* in this embodiment refers to pore portions formed in the elastic layer 24*a*. Examples of the pore portions may include those in which only pores are formed by deflation of capsules after the molding of the elastic layer 24*a* and those in which pores are formed with microballoons such as glass balloons in capsules after the molding of the elastic layer 24*a*.

As described above, in the elastic layer 24*a*, it is preferable that the needle-like filler 24*d* in an amount of 5 vol. % or more and 40 vol. % or less and the hollow member (pore portions) 24*e* in an amount of o1 vol. % or more and 10 vol. % or less are dispersed.

(d) Definition of Orientation Degree of Needle-Like Filler

In order to know the thermal conductivity of the elastic layer 24*a*, an orientation degree (orientation percentage) of the needle-like filler 24*d* in the elastic layer 24*a* is defined. Here, an inclination (angle) of the filler when a surface A shown in (a) of FIG. 4 is viewed and an inclination (angle) of the filler when a surface B shown in (b) of FIG. 4 is viewed were observed. A distribution (orientation degree) of the inclination of each of the fillers when the surfaces A and B were viewed was checked. When the surface A is observed, in the case where the filler with a large inclination (angle) is present in a large amount, the heat insulating performance of the elastic layer 24*a* in the thickness direction is impaired. When the surface B is observed, in the case where the filler with a large inclination is present in a large amount, the thermal conductivity with respect to the roller longitudinal direction is impaired. Therefore, during both the observation of the surfaces A and B, the largely inclined filler may preferably be small in amount.

The definition of the orientation degree will be described with reference to FIG. 4 which illustrates the definition of the orientation degree. In FIG. 4, (a) is an enlarged perspective view of the sample 24*a*1 cut in a dimension of 10.0 mm (x direction)×10.0 mm (y direction)×1.0 mm (z direction) from the elastic layer 24*a* of the elastic layer molded product shown in (a) of FIG. 3, (b) is an enlarged perspective view of the sample 24*a*2 obtaining by cutting in half at the center with respect to the thickness direction (z direction), a sample cut in a dimension of 10.0 mm (x direction)×10.0 mm (y direction)×1.0 mm (z direction), and (c) is a schematic view for illustrating an extracting procedure of the needle-like filler from each of the sample 24*a*1 and 24*a*2.

The orientation degree of the needle-like filler 24*d* is obtained by using the sample 24*a*1 shown in (a) of FIG. 4 and the sample 24*a*2 shown in (b) of FIG. 4. First, as shown in (a) of FIG. 3, two cut samples 24*a*1 are prepared and one of them is cut at the thickness center portion to prepare the sample 24*a*2. Each of the samples 24*a*1 and 24*a*2 was heated for 1 hour at 1000° C. in a nitrogen gas atmosphere by using a thermogravimetric analyzer ("TGA851e/SDTA", mfd. by Mettler-Toledo International Inc.), so that the silicone rubber was decomposed and removed. Thus, when the sample is sintered, even in a state in which the fluorine-containing resin layer is present at the surface of the sample, not only the silicone rubber but also the fluorine-containing resin layer can be removed. When the silicone rubber is removed, the needle-like filler remains in the substantially same form as at the time of the presence of the silicone rubber. Then, each of the samples 24*a*1 and 24*a*2 from which the silicone rubber was removed was cooled and thereafter was subjected to observation of the surface A for the sample 24*a*1 and the surface B for the sample 24*a*2 through Confocal microscope ("OPTELICS C130", mfd. by Lasertec Corp.). An observation area of the surface A is 1.3 mm (y direction)×1.0 mm (z direction). The thickness of 1.0 mm (z direction) corresponds to the entire thickness of the sample 24*a*1. With respect to the sample 24*a*1, the observation was performed at 5 points each in the area of 1.4 mm×1.0 mm. The observation area of the surface B is 1.4 mm (x direction)×1.0 mm (y direction). With respect to the sample 24*a*2, the observation was performed at 5 points each in the area of 1.4 mm×1.0 mm. From each of observation images of the surfaces A and B, only the needle-like filler 24*d* was extracted ((c) of FIG. 4) and the angle of the extracted needle-like filler 24*d* was measured. Incidentally, the observation image of each of the surface A of the sample 24*a*1 and the surface B of the sample 24*a*2 is obtained by observing an observation surface in a depth of 50 μm. In this case, the roller longitudinal direction (y direction of (c) of FIG. 4) of the elastic layer 24*a* is taken as the angle of 0 degrees, and the angle θ of each needle-like filler 24*d* was calculated. The angle θ of the needle-like filler 24*d* closer to 0 degrees means that the fibers of the needle-like filler 24*d* are oriented in a larger amount in the roller longitudinal direction. A proportion (percentage) determined by: [(needle-like filler within ±5 degrees/all extracted needle-like filler)×100%] was obtained with respect to each of the samples 24*a*1 and 24*a*2, so that an average of measurement results at arbitrary 5 points was defined as the orientation degree.

At each of the surfaces A and B, when the fibers of the needle-like filler 24*d* with the angles θ within ±5 degrees are present in an amount (orientation degree) of 20% or more in the entire needle-like filler 24*d*, the following functional effect can be obtained. That is, the thermal conductivity of the elastic layer 24*a* with respect to the roller longitudinal direction is better and a desired non-sheet-passing portion temperature rise alleviating effect is achieved. Further, it is possible to enhance the heat insulating performance of the elastic layer 24*a* with respect to the thickness direction.

3-1-2) Tube 24*b*

The tube 24*b* is provided on the outer peripheral surface of the elastic layer 24*a*. Specifically, as the tube 24*b*, PFA tube, FEP tube and the like may suitably be used but the tube 24*b* is not limited to these tubes. In this embodiment, a 50 μm-thick tube 24*b* is used but the thickness is not particularly limited when the tube 24*b* has the thickness in which a sufficient parting property is imparted to the pressing roller 24.

3-2) Manufacturing Method of Pressing Roller 24

As a manufacturing method of the pressing roller 24, it is generally possible to use a molding method such as metal molding or coat molding can be used.

The needle-like filler 24*d* has the elongated fiber shape and therefore when is kneaded with the liquid addition-curable silicone rubber before curing and then is molded, the fiber length portion L of the needle-like filler 24*d* is liable to be oriented in the flowing direction of the liquid addition-curable silicone rubber, i.e., the roller longitudinal direction of the elastic layer 24*a*. For that reason, when the liquid addition-curable silicone rubber before curing is cured to mold the elastic layer 24*a*, the thermal conductivity of the elastic layer 24*a* with respect to the roller longitudinal direction is enhanced.

3-3) Evaluation of Pressing Roller 24

<Orientation Degree>

The orientation degree was obtained in accordance with the above-described definition with respect to each of pressing rollers in Embodiments 1 to 7 and Comparative Embodiments 1 to 7 described later.

<Thermal Conductivity>

A measuring method of the thermal conductivity of the elastic layer 24*a* will be described with reference to FIG. 5. The thermal conductivity with respect to each of the thickness direction (z direction) and the roller longitudinal direction (y direction) can be measured by a hot disc method thermal properties measuring system ("TPA-501" (trade name), mfd. by Kyoto Electronics Manufacturing Co., Ltd.). In this case, in order to ensure a sufficient thickness for measurement, only the elastic layer 24*a* is cut in pieces each having a predetermined size and the predetermined number of pieces are stacked to prepare a measuring sample. In this embodiment, the measuring sample was prepared by cutting the elastic layer 24*a* having the thermal conductivity anisotropy into pieces each having a size of 16 mm (x direction, roller circumferential direction×16 mm (y direction) x set thickness (z direction) and by stacking the pieces so as to provide the thickness of about 16 mm with respect to the z direction.

When the thermal conductivity was measured, as shown in (b) of FIG. 5, the measuring sample was fixed with kapton tape T of 0.07 mm in thickness and 10 mm in width. Then, in order to uniformize the flatness of a measuring surface, the measuring surface and a surface opposite from the measuring surface were cut with a razor (knife). Thus, as shown in (c) of FIG. 5, a set (pair) of the measuring samples was prepared, and a sensor S was sandwiched between the set of the measuring samples and then was subjected to the measurement. In the case where the measurement of the measuring sample by changing the measuring direction (y direction, z direction), the above-described method may be effected after the measuring direction is changed. An average of 5 times of the measurement was used as the thermal conductivity in this embodiment.

<Evaluation of Non-Sheet-Passing Portion Temperature Rise>

The non-sheet-passing portion temperature rise was evaluated after each of the pressing rollers in Embodiments 1 to 7 and Comparative Embodiments 1 to 7 was mounted in a film-heating type fixing device. In each of printers in which the respective fixing devices were mounted, the peripheral speed (process speed) of the pressing roller of the fixing device was adjusted at 370 mm/sec and the fixing temperature was set at 180° C. at the surface of the fixing film. The recording material passed through the nip of the fixing device was A4-sized paper (80 g/m$^2$). The non-sheet-passing portion temperature rise (temperature at the non-sheet-passing portion) on the fixing film surface was measured at the time when 500 sheets were continuously passed through the nip at rate of 60 sheets/min.

<Rising Performance>

The rising performance was evaluated by measuring the surface temperature of the fixing film surface at the time of rising of the fixing device in each printer. Specifically, a time until the temperature of the fixing film surface reaches a predetermined fixing temperature (target temperature) was measured. Here, the time of rising refers to the time from start of energization to the heater until the fixing film surface temperature is increased up to the fixable temperature.

<Evaluation Results>

The evaluation results of the pressing rollers in Embodiments 1 to 7 and Comparative Embodiments 1 to 7 were summarized in Table 1 appearing at the last of the description on the pressing rollers in Embodiments 1 to 7 and Comparative Embodiments 1 to 7.

3-4) Pressing Rollers in Embodiments 1 to 7 and Comparative Embodiments 1 to 7

The needle-like filler 24*d* and the hollow member 24*e* which were used in each of the pressing rollers in Embodiments 1 to 7 and Comparative Embodiments 1 to 7 will be described. As the needle-like filler 24*d*, three types (A) to (C) of pitch-based carbon fibers shown below are used. Further, as the hollow member 24*e*, three types (D) to (F) of resin balloons shown below were used.

(A) Type: 100-15M

Trade name: "XN-100-15M" (mfd. by Nippon Graphite Fiber Corp.)

Average fiber diameter: 9 μm

Average fiber length: 150 μm

Thermal conductivity: 900 W/(mK)

(B) Type: 100-05M

Trade name: "XN-100-05M" (mfd. by Nippon Graphite Fiber Corp.)

Average fiber diameter: 9 μm

Average fiber length: 50 μm

Thermal conductivity: 900 W/(mK)

(C) Type: 100-01

Trade name: "XN-100-01" (mfd. by Nippon Graphite Fiber Corp.)

Average fiber diameter: 10 μm

Average fiber length: 1 mm

Thermal conductivity: 900 W/(mK)

(D) Type: 80SDE

Trade name: "F-80SDE" (mfd. by Matsumoto Yushi-Seiyaku Co., Ltd.)

Average particle size: 20-40 μm (E) Type: 50E

Trade name: "F-50E" (mfd. by Matsumoto Yushi-Seiyaku Co., Ltd.)

Average particle size: 40-70 μm

Here, this material has a high water content and therefore the hollow member 24*e* is dried, before mixing, in a drying step.

(F) Type: 80DE

Trade name: "F-80DE" (mfd. by Matsumoto Yushi-Seiyaku Co., Ltd.)

Average particle size: 9 μm 3-4-1) Effect of Forming Hollow Member 24*e*

A pressing roller having a constitution in which the needle-like filler 24*d* was contained in the elastic layer 24*a* formed on the outer peripheral surface of the metal core 24*c* and in which the hollow member 24*e* was dispersed in the elastic layer 24*a* was used as a pressing roller P1 in Embodiment 1. On the other hand, a pressing roller having a constitution in which the needle-like filler 24*d* was contained in the elastic layer 24*a* formed on the outer peripheral surface of the metal core 24*c* and in which the hollow member 24*e* was not dispersed in the elastic layer 24*a* was used as a pressing roller P8 in Comparative Embodiment 1.

(Pressing Roller in Embodiment 1)

The pressing roller P1 in Embodiment 1 includes the elastic layer 24*a* in which the needle-like filler 24*d* is contained as the hollow member 24*e* is formed. With reference to FIGS. 6 and 7, the molding method of the pressing roller P1 will be described. First, the metal core 24*c* formed of Al (aluminum) in a diameter of 21 mm ((a) of FIG. 6).

Then, liquids A and B shown below are mixed in a mixing ratio of 1:1 and thereto, a platinum compound as a catalyst is added, thus obtaining the liquid addition-curable silicone rubber 24*i*.

Weight average molecular weight (Mw)=65000

Number average molecular weight (Mn)=15000

Liquid A: vinyl group concentration (0.863 mol. %), SiH concentration (0 (zero) mol. %), viscosity (7.8 Pa·s)

Liquid B: vinyl group concentration (0.955 mol. %), SiH concentration (0.780 mol. %), viscosity (6.2 Pa·s)

H/Vi=0.43 (when A/B=1/1)

With respect to the pressing roller P1 in Embodiment 1, the pitch-based carbon fiber ("100-15M") as the needle-like filler 24*d* was added in the liquid addition-curable silicone rubber 24*i* so as to occupy the proportion of 20 vol. %. Further, in the liquid addition-curable silicone rubber 24*i*, the resin balloon ("80SDE") was added so as to occupy the proportion of 5 vol. %. The liquid addition-curable silicone rubber 24*i*, the pitch-based carbon fiber ("100-15M") and the resin balloon ("80SDE") were uniformly kneaded to obtain a liquid addition-curable silicone rubber composition 24*i*1 before curing.

Before molding the elastic layer 24*a*, in order to bond the metal core 24*c* and the elastic layer 24*a* together, a primer was applied onto the outer peripheral surface of the metal core 24*c* of Al (21 mm in diameter). Next, as shown in FIG. 7, a 50μ-thick PFA tube subjected to etching at the surface opposing the elastic layer 24*a* was set in a metal mold 25*a* of 25 mm in inner diameter. Further, inside the PFA tube 24*b* set in the metal mold 25*a*, the metal core 24*c* (21 mm in inner diameter) was set so that the center of the axis of the metal core 24*c* and that of the metal mold 25*a* were provided coaxially. Then, in the metal mold 25*a*, end portion metal molds 25*b* were set. Thereafter, the liquid addition-curable silicone rubber composition 24*i*1 was injected in an arrow A direction between the PFA tube 24*b* and the metal core 24*c*, followed by heat-curing for 45 minutes at 170° C. to obtain the pressing roller P1 of 25 mm in outer diameter and 240 mm in axial direction length ((b) of FIG. 6). The thickness of the elastic layer 24*a* was 2.0 mm.

(Pressing Roller in Comparative Embodiment 1)

The pressing roller P8 in Comparative Embodiment 1 was, similarly as in the case of the pressing roller P1 in Embodiment 1, prepared by forming the elastic layer 24*a* on the metal core 24*c*. However, in the elastic layer 24*a*, only the needle-like filler 24*d* was contained but the hollow member 24*e* was not formed.

By comparing the pressing roller P1 in Embodiment 1 with the pressing roller P8 in Comparative Embodiment 1, it is possible to check an effect of forming the hollow member 24*e* in the elastic layer 24*a* having the thermal conductivity anisotropy. With respect to the pressing roller P8 in Comparative Embodiment 1, the constitution thereof was the same as that of the pressing roller P1 in Embodiment 1 except that the hollow member 24*e* was not contained.

Evaluation results of the pressing roller P1 in Embodiment 1 and the pressing roller P8 in Comparative Embodiment 1 are summarized in Table 2 below. Both of the pressing rollers P1 and P8 were prepared by forming the elastic layer 24*a* on the outer peripheral surface of the metal core 24*c*.

TABLE 2

| | | Resin balloon | | Orientation degree | | Thermal conductivity | | Film surface | | | |
|---|---|---|---|---|---|---|---|---|---|---|---|
| | Roller | APS *1 | FP *2 | ±5 Degrees | | W/(m · K) | | NSPPTR *3 | Evalu | RP *4 | Evalu |
| EMB. NO. | NO. | (μm) | (Vol. % | A | B | y | z | (° C.) | a- | (sec) | a- |
| E M B. 1 | P1 | 20-40 | 5 | 42.8 | 37.3 | 13.4 | 2.5 | 205.4 | ◎ | 10.7 | ○ |
| COMP. EMB. 1 | P8 | — | — | 41.9 | 38.2 | 13.3 | 3.2 | 204.9 | ◎ | 11.1 | Δ |

*1: "APS" represents an average particle size.
*2: "FP" represents a formation proportion.
*3: "NSPPTR" represents non-sheet-passing portion temperature rise.
*4: "RS" representsan a rising performance.

In the fixing device including the pressing roller P1 in Embodiment 1, the pressing roller P1 in Embodiment 1 includes, in addition to the constitution of the pressing roller P8 in Comparative Embodiment 1, the hollow member 24*e* formed in the elastic layer 24*a*. Thus, in the pressing roller P1 in Embodiment 1, the hollow member 24*e* is formed in the elastic layer 25*a* but compared with the pressing roller P8 in Comparative Embodiment 1, the orientation degree and the thermal conductivity are comparable and the transfer suppressing effect for the non-sheet-passing portion temperature rise is not impaired. In addition, in the pressing roller P1 in Embodiment 1, the hollow member 24*e* is formed in the elastic layer 24*a* and therefore the thermal conductivity with respect to the z direction is lower than that of the pressing roller P8 in Comparative Embodiment 1, so that the rising performance of the fixing film 23 is improved.

3-4-2) Constitutions with Changed Formation Proportions of Hollow Member 24*e*

Next, as an example of the pressing roller, a constitution in which the elastic layer 24*a* is formed on the outer peripheral surface of a solid rubber elastic layer 24*f* will be described. Further, an effect with respect to the formation proportion of the hollow member 24*e* will be described by using pressing rollers P2, P3 and P4 in Embodiments 2, 3 and 4 and pressing rollers P9, P12 and P13 in Comparative Embodiments 2, 5 and 6.

Parts (a) and (b) of FIG. 8 are structural views of pressing rollers in Embodiments 2, 3 and 4, wherein (a) is a perspective view of a whole solid rubber elastic layer molded product prepared by forming the solid rubber elastic layer 24*f* on the metal core 24*c*, and (b) is a perspective view of the whole-pressing roller prepared by forming the elastic layer 24*a* on the outer peripheral surface of the solid rubber elastic layer 24*f* of the solid rubber elastic layer molded product and then by coating the outer peripheral surface of the elastic layer 24*a* with the tube 24*b*.

(Pressing Roller in Embodiment 2)

The pressing roller P2 in Embodiment 2 is prepared by forming the elastic layer 24*a* on the outer peripheral surface of the solid rubber elastic layer 24*f*. In the elastic layer 24*a*, the needle-like filler 24*d* is contained and the hollow member 24*e* is formed. The elastic layer 24*a* is formed on the outer peripheral surface of the solid rubber elastic layer 24*f*, so that the pressing roller P2 in Embodiment 2 has a higher thickness direction heat insulating effect than that of the pressing roller P1 in Embodiment 1. That is, the pressing roller P2 in Embodiment 2 has a lamination structure of at least two layers including the solid rubber elastic layer 24*f* and the elastic layer 24*a*. As the outermost elastic layer, the elastic layer 24*a* containing the needle-like filler 24*d* which has an average length of 0.05 mm or more and 1 mm or less and has the thermal conductivity anisotropy providing the length direction thermal conductivity of 500 W/(mK) or more is used. In this elastic layer 24*a*, the hollow member 24 is formed and the needle-like filler 24*d* is oriented in the roller longitudinal direction.

With reference to FIGS. 8 and 9, the molding method of the pressing roller in which the elastic layer 24*a* is provided on the outer peripheral surface of the solid rubber elastic layer 24*f* will be described.

First, on the outer peripheral surface of the metal core 24*c* of Al with the diameter of 18 mm, the solid rubber elastic layer 24*f* is provided by using an addition type silicone rubber with a density of 1.20 g/cm$^3$ in accordance with the metal molding method to obtain the solid rubber elastic layer molded product ((a) of FIG. 8). The thickness of the solid rubber elastic layer 24*f* of the solid rubber elastic layer molded product is 2.5 mm and the solid rubber elastic layer molded product has the outer diameter of 23 mm.

Next, the molding method of the elastic layer 24*a* will be described. By the same method as in the case of the pressing roller P1 in Embodiment 1, the liquid addition-curable silicone rubber is obtained.

With respect to the pressing roller P2 in Embodiment 2, the pitch-based carbon fiber ("100-15M") as the needle-like filler 24*d* was added in the liquid addition-curable silicone rubber 24*i* so as to occupy the proportion of 20 vol. %. Further, in the liquid addition-curable silicone rubber 24*i*, the resin balloon ("80SDE") was added so as to occupy the proportion of 1 vol. %. The liquid addition-curable silicone rubber 24*i*, the pitch-based carbon fiber ("100-15M") and the resin balloon ("80SDE") were uniformly kneaded to obtain a liquid addition-curable silicone rubber composition 24*i*2 before curing.

Before molding the elastic layer 24*a*, in order to bond the solid rubber elastic layer 24*f* and the elastic layer 24*a* together, a primer was applied onto the outer peripheral surface of the solid rubber elastic layer 24*f* of the solid rubber elastic layer molded product. Next, as shown in FIG. 9, a 50μ-thick PFA tube subjected to etching at the surface opposing the elastic layer 24*a* was set in a metal mold 25*a* of 25 mm in inner diameter. Further, inside the PFA tube 24*b* set in the metal mold 25*a*, the solid rubber elastic layer molded product (23 mm in inner diameter) was set so that the center of the axis of the metal core 24*c* and that of the metal mold 25*a* were provided coaxially. Then, in the metal mold 25*a*, end portion metal molds 25*b* were set. Thereafter, the liquid addition-curable silicone rubber composition 24*i*2 was injected in an arrow A direction between the PFA tube 24*b* and the solid rubber elastic layer molded product, followed by heat-curing for 45 minutes at 170° C. to obtain the pressing roller P2 of 25 mm in outer diameter and 240 mm in axial direction length ((b) of FIG. 8). The thickness of the elastic layer 24*a* was 1.0 mm.

(Pressing roller in Comparative Embodiment 2)

In the pressing roller P9 in Comparative Embodiment 2, similarly as in the case of the pressing roller P2 in Embodiment 2, the elastic layer 24*a* is formed on the outer peripheral surface of the solid rubber elastic layer 24*f*. In the elastic layer 24*a*, only the needle-like filler 24*d* is contained and the hollow member 24*e* is not formed. By comparing the pressing roller P2 in Embodiment 2 with the pressing roller P9 in Comparative Embodiment 2, it is possible to confirm an effect of formation of the hollow member 24*e*.

Thus, the pressing roller P2 in Comparative Embodiment 2 was prepared in the same manner as in the case of the pressing roller P2 in Embodiment 2 except that the hollow member 24*e* is not contained in the elastic layer 24*a*.

(Pressing Rollers in Embodiments 3 and 4 and Comparative Embodiments 5 and 6)

The pressing rollers P3 and P4 in Embodiments 3 and 4 were, similarly as in Embodiment 2, prepared by forming the elastic layer 24*a* on the outer peripheral surface of the solid rubber elastic layer 24*f*. The pressing rollers P12 and P13 in Comparative Embodiments 5 and 6 were also, similarly as in Embodiment 2, prepared by forming the elastic layer 24*a* on the outer peripheral surface of the solid rubber elastic layer 24*f*. Further, in the pressing rollers P3 and P4 in Embodiments 3 and 4 and the pressing rollers P13 and P14 in Comparative Embodiments 5 and 6, the formation proportion of the hollow member 24*e* in the elastic layer 24*a* is changed.

That is, the pressing rollers, P3, P4, P12 and P13 in Embodiments 3 and 4 and Comparative Embodiments 5 and 6, respectively, were obtained similarly as in the case of the pressing roller P2 in Embodiment 2 except that the formation proportion of the hollow member 24*e* in the elastic layer 24*a* was changed.

Evaluation results of the pressing rollers P2 to P4 in Embodiments 2 to 4 and the pressing rollers P9, P12 and P13 in Comparative Embodiments 2, 5 and 6 are summarized in Table 3 below. Further, relationships among the formation proportion of the hollow member 25*e* in the elastic layer 24*a*, the orientation degree and the thermal conductivity are shown in (a) to (d) of FIG. 10.

TABLE 3

| | | Resin balloon | | Orientation degree | | Thermal conductivity | | Film surface | | | |
|---|---|---|---|---|---|---|---|---|---|---|---|
| | Roller | APS *1 | FP *2 | ±5 Degrees | | W/(m · K) | | NSPPTR *3 | Evalu | RP *4 | Evalu |
| EMB. NO. | NO. | (μm) | (Vol. % | A | B | y | z | (° C.) | a- | (sec) | a- |
| E M B. 2 | P2 | 20-40 | 1 | 46.0 | 40.5 | 13.4 | 3.0 | 208.0 | ◎ | 9.9 | ◎ |
| E M B. 3 | P3 | 20-40 | 5 | 42.9 | 37.2 | 13.5 | 2.4 | 207.9 | ◎ | 9.2 | ◎ |
| E M B. 4 | P4 | 20-40 | 10 | 34.6 | 31.4 | 13.1 | 2.5 | 208.5 | ◎ | 9.3 | ◎ |
| COMP. EMB. 2 | P9 | — | — | 49.0 | 41.6 | 13.4 | 3.3 | 208.2 | ◎ | 10.2 | ○ |
| COMP. EMB. 5 | P12 | 20-40 | 0.5 | 48.0 | 41.2 | 13.4 | 3.2 | 208.1 | ◎ | 10.1 | ○ |
| COMP. EMB. 6 | P13 | 20-40 | 15 | 19.5 | 19.3 | 11.6 | 3.4 | 210.5 | ◎ | 10.3 | ○ |

*1: "APS" represents an average particle size.

*2: "FP" represents a formation proportion.

*3: "NSPPTR" represents non-sheet-passing portion temperature rise.

*4: "RS" representsan a rising performance.

In the fixing device including the pressing roller P2 in Embodiment 2, the pressing roller P2 in Embodiment 2 includes, in addition to the constitution of the pressing roller P9 in Comparative Embodiment 2, the hollow member 24*e* formed in the elastic layer 24*a*. Thus, in the pressing roller P2 in Embodiment 2, the hollow member 24*e* is formed in the elastic layer 25*a* but compared with the pressing roller P9 in Comparative Embodiment 2, the orientation degree and the thermal conductivity are comparable and the transfer suppressing effect for the non-sheet-passing portion temperature rise is not impaired. In addition, in the pressing roller P2 in Embodiment 2, the hollow member 24*e* is formed in the elastic layer 24*a* and therefore the thermal conductivity with respect to the z direction is lower than those of the pressing rollers P9, P12 and P13 in Comparative Embodiments 2, 5 and 6, so that the rising performance of the fixing film 23 is improved.

In the respective fixing devices including the pressing rollers P2 to P4 in Embodiments 2 to 4, the formation proportion of the hollow member 24*e* in each of the elastic layers 24*a* of the pressing rollers P2 to P4 in Embodiments 2 to 4 is changed. As shown in (d) of FIG. 10 ("100-15M", 20 vol. %), the z direction thermal conductivity was lowered only by forming the hollow member 24*e* in the formation proportion of 1 vol. % or more, so that the rising performance of the fixing film 23 was improved. Further, as shown in (a) ("100-15M", 20 vol. %, within ±5 degrees), (b) ("100-15M", 20 vol. %, within ±5 degrees) and (c) ("100-15M", 20 vol. %) of FIG. 10, even when the hollow member 24*e* is formed in the formation proportion up to 10 vol. %, the orientation degree is kept at a level of 20% or more and therefore the y direction thermal conductivity is less liable to be lowered. For this reason, it was possible to improve the rising performance of the fixing film 23 while keeping the temperature rise suppressing effect with respect to the non-sheet-passing portion temperature rise.

In the pressing rollers P12 and P13 in Comparative Embodiments 5 and 6, in addition to the constitution of the pressing roller P9 in Comparative Embodiment 2, the hollow member 24*e* is formed in the elastic layer 24*a* in the formation proportions 0.5 vol. % and 15 vol. %, respectively. However, in the fixing device including the pressing roller P12 in Comparative Embodiment 15, the proportion of the hollow member 24*e* formed in the elastic layer 24*a* of the pressing roller P12 in Comparative Embodiment 4 is low. For this reason, as shown in (d) of FIG. 10, even when compared with the pressing roller P9 in Comparative Embodiment 2 in which the hollow member 24*e* is not formed, the z direction thermal conductivity is not so changed, so that the rising performance of the fixing film 23 is not improved. Further, in the fixing device including the pressing roller P13 in Comparative Embodiment 6, a large amount of the hollow member 24*e* is formed in the elastic layer 24*a* of the pressing roller P13 in Comparative Embodiment 6 and therefore, as shown in (a) of FIG. 10, the thickness direction (z direction) orientation degree of the elastic layer 24*a* is lower than 20%. This is because, as described above with reference to (g) of FIG. 3, the orientation of the needle-like filler 24*d* is hindered by the hollow member 24*e*. As a result, the z direction thermal conductivity is lowered and thus the rising performance of the fixing film 23 is not improved.

As is understood from (a) of FIG. 10, when the formation proportion of the hollow member 24*e* exceeds 10 vol. %, the orientation degree is less than 20%. Therefore, the y direction thermal conductivity is lowered and the z direction thermal conductivity is not lowered. Further, when the formation proportion of the hollow member 24*e* is less than 1 vol. %, the orientation degree is high but the z direction thermal conductivity is not lowered.

From the above, the hollow member 24*e* may preferably be formed in the elastic layer 24*a* having the thermal conductivity anisotropy, in the formation proportion of 1 vol. % or more and 10 vol. % or less. That is, the hollow member 24*e* may preferably be formed in the elastic layer 24*a* at a volume ratio of 1% or more and 10% or less.

3-4-3) Constitutions with Changed Average Particle Sizes of Hollow Member 24*e*

(Pressing Rollers of Embodiment 5 and Comparative Embodiment 7)

A pressing roller P5 in Embodiment 5 and a pressing roller P14 in Comparative Embodiment 7 were, similarly as in the case of the pressing roller P2 Embodiment 2, prepared by forming the elastic layer 24*a* on the outer peripheral surface of the solid rubber elastic layer 24*f*. In the pressing roller P5 in Embodiment 5 and the pressing roller P14 in Comparative Embodiment 7, the average particle size of the hollow member 24*e* formed in the elastic layer 24*a* is changed.

Thus, the pressing rollers P5 and P14 in Embodiment 5 and Comparative Embodiment 7, respectively, were prepared in the same manner as in the case of the pressing roller P2 in Embodiment 2 except that the average particle size of the hollow member 24*e* is changed. Evaluation results of the pressing roller P5 in Embodiment 5 and the pressing roller P14 in Comparative Embodiment 7 are summarized in Table 4.

TABLE 4

| | | Resin balloon | | Orientation degree | | Thermal conductivity | | Film surface | | | |
|---|---|---|---|---|---|---|---|---|---|---|---|
| | Roller | APS *1 | FP *2 | ±5 Degrees | | W/(m · K) | | NSPPTR *3 | Evalu | RP *4 | Evalu |
| EMB. NO. | NO. | (μm) | (Vol. % | A | B | y | z | (° C.) | a- | (sec) | a- |
| E M B. 4 | P4 | 20-40 | 10 | 34.6 | 31.4 | 13.1 | 2.5 | 208.5 | ◎ | 9.3 | ◎ |
| E M B. 5 | P5 | 40-70 | 10 | 33.5 | 30.6 | 12.9 | 2.4 | 209.3 | ◎ | 9.2 | ◎ |
| COMP. EMB. 7 | P14 | 90-110 | 5 | 18.3 | 18.2 | 8.7 | 4.0 | 215.2 | ◎ | 11.5 | Δ |
| COMP. EMB. 2 | P9 | — | — | 49.0 | 41.6 | 13.4 | 3.3 | 208.2 | ◎ | 10.2 | ○ |

*1: "APS" represents an average particle size.
*2: "FP" represents a formation proportion.
*3: "NSPPTR" represents non-sheet-passing portion temperature rise.
*4: "RS" representsan a rising performance.

In the fixing device including the pressing roller P5 in Embodiment 5, the hollow member 24*e* having a large average particle size of 40-70 μm is formed in the elastic layer 24*a*. Even when compared with a pressing roller P4 in Embodiment 4 in which the average particle size of the hollow member 24*e* is 20-40 μm, both of the orientation degree and the thermal conductivity are comparable with those of the pressing roller P4 in Embodiment 4, so that both of the non-sheet-passing portion temperature rise suppressing effect and the rising performance of the fixing film 23 are also substantially comparable with those of the pressing roller P4 in Embodiment 4.

In the fixing device including the pressing roller 14 in Comparative Embodiment 7, the hollow member 24*e* having the average particle size of 90-110 μm which is further larger than that in the pressing roller P5 in Embodiment 5 is formed in the elastic layer 24*a*. For that reason, as described above with reference to (g) of FIG. 3, the orientation of the needle-like filler 24*d* is hindered, so that the orientation degree is lowered. Therefore, compared with the pressing roller P2 in Comparative Embodiment 2, the thermal conductivity with respect to the roller longitudinal direction is lowered and the z direction thermal conductivity is increased. Thus, compared with the pressing roller P9 in Comparative Embodiment 2 in which the hollow member 24*e* is not formed, the non-sheet-passing portion temperature rise suppressing effect and the rising performance of the fixing film 23 are deteriorated.

From the above, the average particle size of the hollow member 24*e* formed in the elastic layer 24*a* may preferably be 70 μm or less.

pressing rollers P10 and P11 in Comparative Embodiments 3 and 4, in the pressing rollers P6 and P7 in Embodiments 6 and 7, the hollow member 24*e* is formed. By comparing the pressing rollers P6 and P7 in Embodiments 6 and 7 with the pressing rollers P10 and P11 of in Comparative Embodiments 3 and 4, respectively, it is possible to confirm the effect of formation of the hollow member 24*e* when the average fiber length and content of the needle-like filler 24*d* in the elastic layer 24*a* are changed.

The pressing rollers 6 and 7 in Embodiments 6 and 7 were prepared in the same manner as in the case of the pressing roller P2 in Embodiment 2 except that the average fiber length and content of the needle-like filler 24*d* in the elastic layer 24*a* were changed. The pressing rollers P10 and P11 in Comparative Embodiments 3 and 4 were prepared in the same manner as in the case of the pressing roller P2 in Embodiment 2 except that the average fiber length and content of the needle-like filler 24*d* in the elastic layer 24*a* were changed and that the hollow member 24*d* was not formed in the elastic layer 24*a*.

Evaluation results of the pressing rollers P6 and P7 in Embodiments 6 and 7 and the pressing rollers P10 and P11 in Comparative Embodiments 3 and 4 are summarized in Table 5.

TABLE 5

| | | Fiber | | Balloon | | OD *5 | | TC *6 | | Film surface | | | |
|---|---|---|---|---|---|---|---|---|---|---|---|---|---|
| | Roller | AFL *1 | CT *2 | APS *3 | FP *4 | ±5° | | W/(m · K) | | NSPPTR *7 | Evaluation | RP *8 | Evaluation |
| EMB. NO. | NO. | (μm) | (Vol %) | (μm) | (Vol %) | A | B | y | z | (° C.) | | (sec) | |
| E M B. 6 | P6 | 50 | 5 | 20-40 | 5 | 20.2 | 20.4 | 2.5 | 2.2 | 220.0 | ◎ | 8.9 | ◎ |
| COMP. EMB. 3 | P10 | 50 | 5 | — | — | 21.3 | 21.5 | 2.6 | 2.9 | 222.3 | ○ | 9.8 | ◎ |
| E M B. 7 | P7 | 1000 | 40 | 20-40 | 5 | 33.2 | 30.1 | 65 | 2.6 | 185.1 | ◎ | 9.5 | ◎ |
| COMP. EMB. 4 | P11 | 1000 | 40 | — | — | 34.5 | 32.3 | 67 | 3.4 | 186.2 | ◎ | 10.3 | ○ |

*1: "AFL" representsan average fiber length.
*2: "CT" represents a content.
*3: "APS" representsan average particle size.
*4: "FP" represents a formation proportion.
*5: "OD" representsan an orientation degree.
*6: "TC" representsan a thermal conductivity.
*7: "NSPPTR" represents non-sheet-passing portion temperature rise.
*8: "RS" representsan a rising performance.

3-4-4) Constitutions with Changed Average Fiber Lengths and Contents of Needle-Like Filler 24*d*

(Pressing Rollers in Embodiments 6 and 7 and Comparative Embodiments 3 and 4)

Pressing rollers P6 and P7 in Embodiments 6 and 7 are, similarly as in the case of the pressing roller P2 in Embodiment 2, prepared by forming the elastic layer 24*a* having the thermal conductivity anisotropy on the outer peripheral surface of the solid rubber elastic layer 24*f*. Further, pressing rollers P10 and P11 in Comparative Embodiments 3 and 4 are also, similarly as in the case of the pressing roller P2 in Embodiment 2, prepared by forming the elastic layer 24*a* having the thermal conductivity anisotropy on the outer peripheral surface of the solid rubber elastic layer 24*f*. In the pressing rollers P6, P7, P1 and P11 in Embodiments 6 and 7 and Comparative Embodiments 3 and 4, respectively, the average fiber length and content of the needle-like filler 24*d* in the elastic layer 24*a* are changed.

The pressing rollers P6 and P7 in Embodiments 6 and 7 are equal in average fiber length and content of the needle-like filler 24*d* in the elastic layer 24*a* to those in the pressing rollers P10 and P11 in Comparative Embodiments 3 and 4, respectively. Further, in addition to the constitutions of the The effect of formation of the hollow member 24*e* when the average fiber length and content of the needle-like filler 24*d* are changed will be confirmed.

In the pressing roller P6 in Embodiment 6 and the pressing roller P10 in Comparative Embodiment 3, the needle-like filler 24*d* having a relatively short average fiber length of 50 μm is contained in the elastic layer 24*a* at the low content of 5 vol. %.

In the fixing device including the pressing roller P6 in Embodiment 6, the pressing roller P6 in Embodiment 6 includes, in addition to the constitution of the pressing roller P10 in Comparative Embodiment 3, the hollow member 24*e* formed in the elastic layer 24*a* having the thermal conductivity anisotropy. Thus, in the pressing roller P6 in Embodiment 6, the hollow member 24*e* is formed in the elastic layer 25*a* but compared with the pressing roller P10 in Comparative Embodiment 3, the orientation degree and the thermal conductivity are comparable and the transfer suppressing effect for the non-sheet-passing portion temperature rise is not impaired. In addition, in the pressing roller P6 in Embodiment 6, the hollow member 24*e* is formed in the elastic layer 24*a* and therefore the thermal conductivity with respect to the z direction is lower than that of the pressing roller P10 in Comparative Embodiment 3, so that the rising performance of the fixing film 23 is improved. As a result, even when the average fiber length of the needle-like filler 24*d* was 50 μm and the content of the needle-like filler 24*d* was 5 vol. %, the effect of formation of the hollow member 24*e* in the elastic layer 24*a* was obtained.

In the pressing roller P7 in Embodiment 7 and the pressing roller P11 in Comparative Embodiment 4, the needle-like filler 24*d* having a relatively long average fiber length of 1 mm is contained in the elastic layer 24*a* at the high content of 40 vol. %.

In the fixing device including the pressing roller P7 in Embodiment 7, the pressing roller P7 in Embodiment 7 includes, in addition to the constitution of the pressing roller P11 in Comparative Embodiment 4, the hollow member 24*e* formed in the elastic layer 24*a* having the thermal conductivity anisotropy. Thus, in the pressing roller P7 in Embodiment 7, the hollow member 24*e* is formed in the elastic layer 25*a* but compared with the pressing roller P11 in Comparative Embodiment 4, the orientation degree and the thermal conductivity are comparable and the transfer suppressing effect for the non-sheet-passing portion temperature rise is not impaired. In addition, in the pressing roller P7 in Embodiment 7, the hollow member 24*e* is formed in the elastic layer 24*a* and therefore the thermal conductivity with respect to the z direction is lower than that of the pressing roller P11 in Comparative Embodiment 4, so that the rising performance of the fixing film 23 is improved. As a result, even when the average fiber length of the needle-like filler 24*d* was 1 mm and the content of the needle-like filler 24*d* in the elastic layer 24*a* was 40 vol. %, the effect of formation of the hollow member 24*e* in the elastic layer 24*a* was obtained.

(Pressing Roller in Comparative Embodiment 8)

In the pressing roller in Comparative Embodiment 8, the content of the needle-like filler 24*d* was 45 vol. % which was excessively large and therefore the viscosity was very high when the needle-like filler 24*d* was mixed with the liquid addition-curable silicone rubber, so that it was impossible to mold the elastic layer 24*a*.

From the above, the average fiber length of the needle-like filler 24*d* contained in the elastic layer 24*a* may preferably be 50 μm or more and 1 mm or less. The content of the needle-like filler 24*d* in the elastic layer 24*a* may preferably be 5 vol. % or more and 40 vol. % or less. That is, the elastic layer 24*a* may preferably contain the needle-like filler 24*d* at a volume ratio of 5% or more and 40% or less.

As described above, when the orientation degree of the needle-like filler 24*d* at the surface B (cross section of the elastic layer 24*a* at the thickness center portion) of the cut sample 24*a*1 from the elastic layer molded product is high, the thermal conductivity of the elastic layer 24*a* with respect to the roller longitudinal direction is good. Further, when the orientation degree of the needle-like filler 24*d* at the surface A (cross section of the elastic layer 24*a* with respect to the longitudinal direction) of the cut sample 24*a*1 from the elastic layer molded product is low, the thermal conductivity of the elastic layer 24*a* with respect to the thickness direction is not lowered. As a result, by defining the orientation degree of the needle-like filler 24*d* in the elastic layer 24*a*, it is possible to estimate the thermal conductivity of the elastic layer 24*a*.

In the pressing rollers in Embodiments 1 to 7 and Comparative Embodiments 1 to 8, when both of the orientation degrees at the surfaces A and B are 20% or more in terms of the percentage of the fibers of the needle-like filler 24*d* with the angle of within ±5 degrees when the roller longitudinal direction is taken as 0 degrees, the following effects can be achieved. That is, even when the hollow member 24*e* is formed in the elastic layer 24*a*, the non-sheet-passing portion temperature rise suppressing effect comparable to that of the pressing roller in which the hollow member 24*e* is not formed in the elastic layer 24*a* can be obtained and the rising performance of the fixing film 23 can also be improved.

As shown in Table 1 below, the pressing rollers having the orientation degree of 20% or more at both of the surfaces A and B are the pressing rollers P1 to P7 in Embodiments 1 to 7 and the pressing rollers P8 to P12 in Comparative Embodiments 1 to 5.

Further, as in the pressing rollers in Comparative Embodiments 7 and 8, in the case where the orientation degrees at the surfaces A and B are less than 20%, even when the hollow member 24*e* is formed in the elastic layer 24*e*, the rising performance of the fixing film 23 cannot be improved while keeping the temperature rise suppressing effect with respect to the non-sheet-passing portion temperature rise.

Further, when the thermal conductivity of the needle-like filler 24*d* with respect to the length direction is not 500 W/cm·K) or more, the roller longitudinal direction thermal conductivity of the elastic layer 24*a* having the thermal conductivity anisotropy is low, so that the effect of alleviating the degree of the non-sheet-passing portion temperature rise becomes small.

TABLE 1

| | | | | Fiber | | Balloon | | OD *7 | |
|---|---|---|---|---|---|---|---|---|---|
| | Roller | SPELT *1 | ELT *2 | AFL *3 | CT *4 | APS *5 | FP *6 | ±5° | |
| EMB. NO. | NO. | (mm) | (mm) | (μm) | (Vol. %) | (μm) | (Vol. %) | A | B |
| E M B. 1 | P1 | 0 | 2 | 150 | 20 | 20-40 | 5 | 42.8 | 37.3 |
| E M B. 2 | P2 | 3 | 1 | 150 | 20 | 20-40 | 1 | 46.0 | 40.5 |
| E M B. 3 | P3 | 3 | 1 | 150 | 20 | 20-40 | 5 | 42.9 | 37.2 |
| E M B. 4 | P4 | 3 | 1 | 150 | 20 | 20-40 | 10 | 34.6 | 31.4 |
| E M B. 5 | P5 | 3 | 1 | 150 | 20 | 40-70 | 10 | 33.5 | 30.6 |
| E M B. 6 | P6 | 3 | 1 | 50 | 5 | 20-40 | 5 | 20.2 | 20.4 |
| E M B. 7 | P7 | 3 | 1 | 1000 | 40 | 20-40 | 5 | 33.2 | 30.1 |
| COMP. EMB. 1 | P8 | 0 | 2 | 150 | 20 | — | — | 41.9 | 38.2 |
| COMP. EMB. 2 | P9 | 3 | 1 | 150 | 20 | — | — | 49.0 | 41.6 |
| COMP. EMB. 3 | P10 | 3 | 1 | 50 | 5 | — | — | 21.3 | 21.5 |
| COMP. EMB. 4 | P11 | 3 | 1 | 1000 | 40 | — | — | 34.5 | 32.3 |
| COMP. EMB. 5 | P12 | 3 | 1 | 150 | 20 | 20-40 | 0.5 | 48.0 | 41.2 |
| COMP. EMB. 6 | P13 | 3 | 1 | 150 | 20 | 20-40 | 15 | 19.5 | 19.3 |
| COMP. EMB. 7 | P14 | 3 | 1 | 150 | 20 | 90-110 | 5 | 18.3 | 18.2 |
| COMP. EMB. 8 | — | — | — | 150 | 45 | — | — | — | — |

TABLE 1-continued

| | TC *8 | | Film surface | | | |
|---|---|---|---|---|---|---|
| | W/(m · K) | | NSPPTR *9 | Evalua- | RP *10 | Evalua- |
| EMB. NO. | y | z | (° C.) | tion | (sec) | tion |
| E M B. 1 | 13.4 | 2.5 | 205.4 | ◎ | 10.7 | ○ |
| E M B. 2 | 13.4 | 3.0 | 208.0 | ◎ | 9.9 | ◎ |
| E M B. 3 | 13.5 | 2.4 | 207.9 | ◎ | 9.2 | ◎ |
| E M B. 4 | 13.1 | 2.5 | 208.5 | ◎ | 9.3 | ◎ |
| E M B. 5 | 12.9 | 2.4 | 209.3 | ◎ | 9.2 | ◎ |
| E M B. 6 | 2.5 | 2.2 | 220.0 | ◎ | 8.9 | ◎ |
| E M B. 7 | 65.0 | 2.6 | 185.1 | ◎ | 9.5 | ◎ |
| COMP. EMB. 1 | 13.3 | 3.2 | 204.9 | ◎ | 11.1 | Δ |
| COMP. EMB. 2 | 13.4 | 3.3 | 208.2 | ◎ | 10.2 | ○ |
| COMP. EMB. 3 | 2.6 | 2.9 | 222.3 | ○ | 9.8 | ◎ |
| COMP. EMB. 4 | 67.0 | 3.4 | 186.2 | ◎ | 10.3 | ○ |
| COMP. EMB. 5 | 13.4 | 3.2 | 208.1 | ◎ | 10.1 | ○ |
| COMP. EMB. 6 | 11.6 | 3.4 | 210.5 | ◎ | 10.3 | ○ |
| COMP. EMB. 7 | 8.7 | 4.0 | 215.2 | ◎ | 11.5 | Δ |
| COMP. EMB. 8 | — | — | — | — | — | — |

*1: "SPELT" representsan a silicone rubber elastic layer thickness.
*2: "ELT" representsan an elastic layer thickness.
*3: "AFL" representsan average fiber length.
*4: "CT" represents a content.
*5: "APS" representsan average particle size.
*6: "FP" represents a formation proportion.
*7: "OD" representsan an orientation degree.
*8: "TC" representsan a thermal conductivity.
*9: "NSPPTR" represents non-sheet-passing portion temperature rise.
*10: "RS" representsan a rising performance.

As described above, the pressing roller 24 in the present invention includes the elastic layer 24*a* containing the needle-like filler 24*d* which has an average length of 0.05 mm or more and 1 mm or less and has the thermal conductivity anisotropy providing the length direction thermal conductivity of 500 W/(mK) or more. In this elastic layer 24*a*, the hollow member 24 is formed and the needle-like filler 24*d* is oriented in the roller longitudinal direction. As a result, the pressing roller 24 in the present invention achieves such a functional effect that the thermal conductivity of the elastic layer 24*a* with respect to the roller longitudinal direction and the heat insulating property of the elastic layer 24*a* with respect to the thickness direction can be improved. Therefore, the fixing device in the present invention having the constitution in which the pressing roller 24 is used achieves the functional effect such that the degree of the non-sheet-passing portion temperature rise can be reduced and that the rising time of the fixing device, i.e., the time from the start of energization to the heater until the temperature of the heater reaches the fixable temperature can be shortened.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 160570/2010 filed Jul. 15, 2010 and 141762/2011 filed Jun. 27, 2011, which are hereby incorporated by reference.

What is claimed is:

1. A pressing roller comprising:

a metal core; and an elastic layer containing a filler which has an average length of 0.05 mm or more and 1 mm or less and a thermal conductivity of 500 W/(mK) or more, wherein in said elastic layer containing the filler, pore portions are dispersed, wherein the pore portions have an average diameter of 70 μm or less, wherein said elastic layer contains the filler of 5% or more and 40% or less in volume ratio, and the pore portions are formed with a volume ratio of 1% or more and 10% or less, wherein a volume ratio of the pore portions is not more than a volume ratio of the filler, and wherein the total volume ratio of the filler and the pore portions is not less than 10% and not more than 45%.

2. A roller according to claim 1, wherein the filler has an orientation degree of 20% or more.

3. A roller according to claim 1, wherein the filler is a pitch based carbon fiber.

4. A roller according to claim 1, wherein the pore portions are formed with at least one species of a resin balloon, a glass balloon, a silica balloon, a carbon balloon and Shirasu balloon.

5. An image heating device comprising:

a heating member configured to heat a recording material on which an image is carried;

a pressing roller including a metal core and an elastic layer containing a filler which has an average length of 0.05 mm or more and 1 mm or less and a thermal conductivity of 500 W/(mK) or more, wherein said elastic layer forms, together with said heating member, a nip in which the recording material is to be nip-conveyed, wherein in said elastic layer containing the filler, pore portions are dispersed, wherein the pore portions have an average diameter of 70 μm or less, wherein said elastic layer contains the filler of 5% or more and 40% or less in volume ratio, and the pore portions are formed with a volume ratio of 1% or more and 10% or less, wherein a volume ratio of the pore portions is not more than a volume ratio of the filler, and wherein the total volume ratio of the filler and the pore portions is not less than 10% and not more than 45%.

6. A device according to claim 5, wherein the filler has an orientation degree of 20% or more.

7. A device according to claim 5, wherein the filler is a pitch based carbon fiber.

8. A device according to claim 5, wherein said heating member includes a cylindrical film and a heater.

9. A device according to claim 8, wherein the heater is contacted to an inner surface of the film, and the nip is formed between said pressing roller and the film.

10. A device according to claim 5, wherein the pore portions are formed with at least one species of a resin balloon, a glass balloon, a silica balloon, a carbon balloon and Shirasu balloon.

* * * * *